US008261711B2

(12) United States Patent
Shimoda

(10) Patent No.: US 8,261,711 B2
(45) Date of Patent: Sep. 11, 2012

(54) IGNITION DEVICE OF INTERNAL COMBUSTION ENGINE AND ELECTRODE STRUCTURE OF THE IGNITION DEVICE

(75) Inventor: Kenjiro Shimoda, Nagoya (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 13/271,644

(22) Filed: Oct. 12, 2011

(65) Prior Publication Data

US 2012/0060785 A1 Mar. 15, 2012

Related U.S. Application Data

(63) Continuation of application No. PCT/JP2011/053826, filed on Feb. 22, 2011.

(30) Foreign Application Priority Data

Apr. 26, 2010 (JP) ..... 2010-100691

(51) Int. Cl.
*H01T 13/20* (2006.01)
*H01T 13/34* (2006.01)

(52) U.S. Cl. ..... 123/169 EL; 123/169 E; 313/130; 313/139

(58) Field of Classification Search ..... 123/143 R, 123/169 EL, 169 E; 313/130, 139
See application file for complete search history.

(56) References Cited

U.S. PATENT DOCUMENTS 3,567,987 A * 3/1971 Schnurmacher ..... 313/123
4,275,328 A * 6/1981 Watanabe et al. ..... 313/123
4,631,451 A * 12/1986 Anderson et al. ..... 315/209 R
4,639,635 A * 1/1987 Lee ..... 313/123
4,841,925 A * 6/1989 Ward ..... 123/143 B
4,870,319 A * 9/1989 Benedikt et al. ..... 313/137
8,053,965 B2 * 11/2011 Boehler et al. ..... 313/141

FOREIGN PATENT DOCUMENTS

JP 54-015134 U 1/1979
JP 60-121692 A1 6/1985
JP 62-005582 A1 1/1987
JP 05-036463 A1 2/1993

OTHER PUBLICATIONS

International Search Report dated May 10, 2011.

* cited by examiner

*Primary Examiner* — Erick Solis
(74) *Attorney, Agent, or Firm* — Burr & Brown

(57) ABSTRACT

An ignition device having an electrode structure including an anode, a cathode, an auxiliary electrode, an anode coating, an auxiliary electrode coating, and an anode supporting body. A coated surface of the anode is opposed to a coated surface of the auxiliary electrode with the anode coating, a combustion space, and the auxiliary electrode coating therebetween. An exposed surface of the anode is opposed to an exposed surface of the cathode with the combustion space therebetween. A distance D1 from the coated surface of the anode to the coated surface of the auxiliary electrode via the anode coating, the combustion space, and the auxiliary electrode coating is shorter than a distance D2 from the exposed surface of the anode to the exposed surface of the cathode via the combustion space (D1<D2). A combustion bomb may be used as the cathode.

20 Claims, 22 Drawing Sheets

B–B

D-D

IGNITION DEVICE OF INTERNAL COMBUSTION ENGINE AND ELECTRODE STRUCTURE OF THE IGNITION DEVICE

FIELD OF THE INVENTION

The present invention relates to an ignition device of an internal combustion engine and an electrode structure of the ignition device.

BACKGROUND OF THE INVENTION

Spark plugs for generating discharge in gaps between anodes and cathodes are widely used in order to ignite fuel-air mixtures filling combustion spaces of internal combustion engines such as automobile engines.

In the spark plugs, when the gaps between the anodes and cathodes are widened, discharge is not generated if voltages to be applied between the anodes and the cathodes are not heightened. Further, depending on compositions and pressures of the fuel-air mixtures, discharge is generated at unintended timing and the spark plugs may be damaged by arc discharge, thereby causing a problem that the stability of the discharge is deteriorated. Since the compositions and pressures of the fuel-air mixtures are not constant, the deterioration in the stability of the discharge causes deterioration in stability of igniting the fuel-air mixtures.

However, when the gaps between the anodes and the cathodes are not widened, a discharge that spread widely and three-dimensionally is not generated, thereby causing another problem such that combustion efficiency and a combustion speed of the ignition of the fuel-air mixtures are not improved.

In order to solve these problems, a spark plug in Patent Document 1 is provided with an auxiliary electrode (floating electrode 11) in addition to an anode (center electrode 3) and a cathode (outside electrode 6), so that a gap between the anode and the cathode is widened.

PRIOR ART DOCUMENT

Patent Document

Patent Document 1: Japanese Patent Application Laid-Open No. 5-36463 (1993)

SUMMARY OF THE INVENTION

Problems to be Solved by the Invention

However, although the spark plug in Patent Document 1 is useful, its effect is still insufficient, and thus an ignition device for stably generating discharge spreading widely and three-dimensionally is needed.

The present invention has been devised in order to solve these problems, and an object thereof is to provide an ignition device for stably generating discharge spreading widely and three-dimensionally within an electrode structure of the ignition device.

Means for Solving the Problems

Means for solving the above problems will be described below.

According to a first aspect of the present invention, an electrode structure of an ignition device for igniting a fuel-air mixture filling a combustion space of an internal combustion engine, includes a first electrode that is made of a conductor and has a bar shape, a second electrode made of a conductor, an auxiliary electrode made of a conductor, a first dielectric barrier that is made of a dielectric body and partially coats a surface of the first electrode, and a second dielectric barrier that is made of a dielectric body and entirely or partially coats a surface of the auxiliary electrode, wherein the surface of the first electrode includes a first exposed surface exposed in the combustion space, and a first coated surface coated with the first dielectric barrier, a surface of the second electrode includes a second exposed surface exposed in the combustion space, and the surface of the auxiliary electrode includes a second coated surface coated with the second dielectric barrier, the first exposed surface is opposed to the second exposed surface with the combustion space therebetween, the first coated surface is opposed to the second coated surface with the first dielectric barrier, the combustion space, and the second dielectric barrier therebetween, and a first distance from the first coated surface to the second coated surface via the first dielectric barrier, the combustion space, and the second dielectric barrier is shorter than a second distance from the first exposed surface to the second exposed surface via the combustion space.

A second aspect of the present invention is directed to the electrode structure according to the first aspect, wherein the first exposed surface is at a front end of the first electrode, a first opening is formed on the second electrode, and the second exposed surface is at an outer edge of the first opening, and the first electrode protrudes from the first opening.

A third aspect of the present invention is directed to the electrode structure according to the second aspect, wherein the first opening has a circular shape, and the first electrode is arranged on a central axis that passes through a center of the first opening and is perpendicular to the first opening.

A fourth aspect of the present invention is directed to the electrode structure according to the first aspect, wherein two or more of the second electrodes are provided, and the first electrode protrudes from a gap between the two or more second electrodes.

A fifth aspect of the present invention is directed to the electrode structure according to any of the first to fourth aspects, wherein a second opening having a circular shape is formed on the auxiliary electrode, and the first electrode is arranged on a central axis that passes through a center of the second opening and is perpendicular to the second opening.

A sixth aspect of the present invention is directed to the electrode structure according to any of the first to fifth aspects, wherein the first exposed surface has an apex.

A seventh aspect of the present invention is directed to the electrode structure according to the sixth aspect, wherein the apex faces an extending direction of the first electrode and a direction separating from the second exposed surface.

An eighth aspect of the present invention is directed to the electrode structure according to any of the first to seventh aspects, wherein a portion of the first exposed surface opposed to the second exposed surface has a convex curve.

According to a ninth aspect of the present invention, an ignition device for igniting a fuel-air mixture filling a combustion space of an internal combustion engine, includes a pulse power supply, an electrode structure, and a pulse voltage transmission path for connecting the pulse power supply and the electrode structure, wherein the electrode structure includes a first electrode that is made of a conductor and has a bar shape, a second electrode made of a conductor, an auxiliary electrode made of a conductor, a first dielectric barrier that is made of a dielectric body and partially coats a surface of the first electrode, and a second dielectric barrier that is made of a dielectric body and entirely or partially coats a surface of the auxiliary electrode, the surface of the first electrode includes a first exposed surface exposed in the combustion space, and a first coated surface coated with the first dielectric barrier, a surface of the second electrode includes a second exposed surface exposed in the combustion space, and the surface of the auxiliary electrode includes a second coated surface coated with the second dielectric barrier, the first exposed surface is opposed to the second exposed surface with the combustion space therebetween, the first coated surface is opposed to the second coated surface with the first dielectric barrier, the combustion space, and the second dielectric barrier therebetween, a first distance from the first coated surface to the second coated surface via the first dielectric barrier, the combustion space, and the second dielectric barrier is shorter than a second distance from the first exposed surface to the second exposed surface via the combustion space.

According to a tenth aspect of the present invention, an electrode structure of an ignition device for igniting a fuel-air mixture filling a combustion space of an internal combustion engine, includes a first electrode that is made of a conductor and has a bar shape, an auxiliary electrode made of a conductor, a first dielectric barrier that is made of a dielectric body and partially coats a surface of the first electrode, and a second dielectric barrier that is made of a dielectric body and entirely or partially coats a surface of the auxiliary electrode, wherein the surface of the first electrode includes an exposed surface exposed in the combustion space, a first coated surface coated with the first dielectric barrier, and the surface of the auxiliary electrode includes a second coated surface coated with the second dielectric barrier, the exposed surface is opposed to an inner wall surrounding the combustion space with the combustion space therebetween, the first coated surface is opposed to the second coated surface with the first dielectric barrier, the combustion space, and the second dielectric barrier therebetween, and a first distance from the first coated surface to the second coated surface via the first dielectric barrier, the combustion space, and the second dielectric barrier is shorter than a second distance from the exposed surface to the inner wall via the combustion space.

According to an eleventh aspect of the present invention, an ignition device for igniting a fuel-air mixture filling a combustion space of an internal combustion engine, includes a pulse power supply, an electrode structure, and a pulse voltage transmission path for connecting the pulse power supply and the electrode structure, wherein the electrode structure includes a first electrode that is made of a conductor and has a bar shape, an auxiliary electrode made of a conductor, a first dielectric barrier that is made of a dielectric body and partially coats a surface of the first electrode, and a second dielectric barrier that is made of a dielectric body and entirely or partially coats a surface of the auxiliary electrode, the surface of the first electrode includes an exposed surface exposed in the combustion space, a first coated surface coated with the first dielectric barrier, and the surface of the auxiliary electrode includes a second coated surface coated with the second dielectric barrier, the exposed surface is opposed to an inner wall surrounding the combustion space with the combustion space therebetween, the first coated surface is opposed to the second coated surface with the first dielectric barrier, the combustion space, and the second dielectric barrier therebetween, and a first distance from the first coated surface to the second coated surface via the first dielectric barrier, the combustion space, and the second dielectric barrier is shorter than a second distance from the exposed surface to the inner wall via the combustion space.

SUMMARY OF THE INVENTION

According to the first to ninth aspects of the present invention, after a pre discharge is generated between the first coated surface and the second coated surface, a main discharge is generated between the first exposed surface and the second exposed surface, and thus the main discharge is stabilized, thereby stably generating discharge spreading widely and three-dimensionally.

According to the second aspect of the present invention, the main discharge spreads widely and three-dimensionally.

According to the third aspect of the present invention, the second distance becomes uniform, and thus the main discharge is uniformly generated.

According to the fourth aspect of the present invention, the main discharge spreads widely and three-dimensionally.

According to the fifth aspect of the present invention, the first distance becomes uniform, and the pre discharge is uniformly generated.

According to the sixth aspect of the present invention, an electric field concentrates on an apex and thus the main discharge is easily generated.

According to the seventh aspect of the present invention, the main discharge extends towards a direction separating from the second exposed surface, and the main discharge spreads widely.

According to the eighth aspect of the present invention, when the first electrode is worn away, a curvature of the first exposed surface becomes small and the main discharge is easily generated. As a result, disturbance of the generation of the main discharge is hardly made by the wear of the first electrode, thereby improving durability of the first electrode.

According to the tenth and eleventh aspects of the present invention, after the pre discharge is generated between the first coated surface and the second coated surface, the main discharge is generated between the exposed surface and the inner wall, and the main discharge becomes stable, thereby stably generating discharge spreading widely and three-dimensionally.

DETAILED DESCRIPTION OF THE INVENTION

{First Embodiment}

A first embodiment relates to an electrode structure of an ignition device for igniting a fuel-air mixture filling a combustion space (combustion chamber) of an internal combustion engine.

Figure 1:
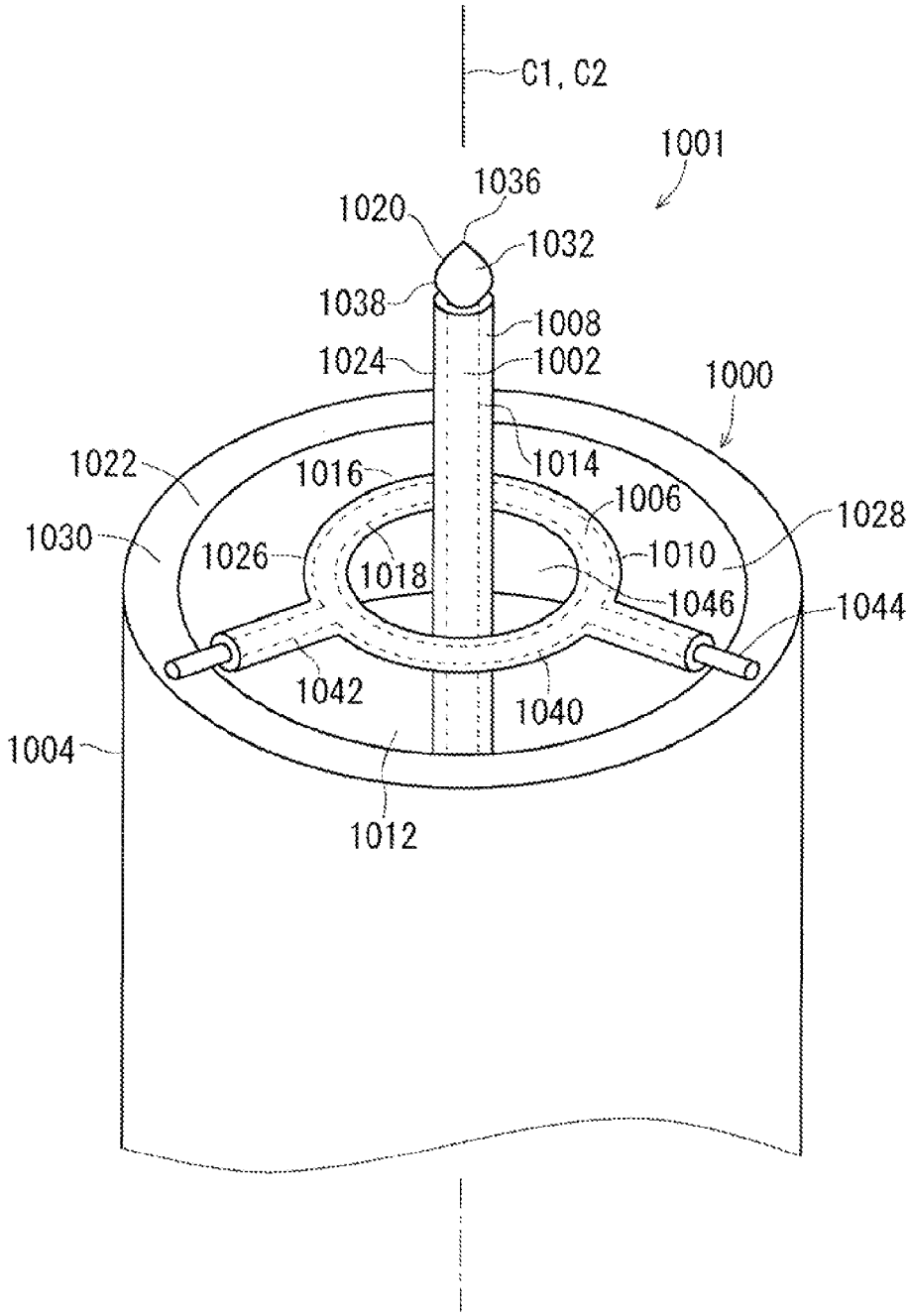
FIG. 1 is a perspective view illustrating an electrode structure according to a first embodiment.
Figure 2:
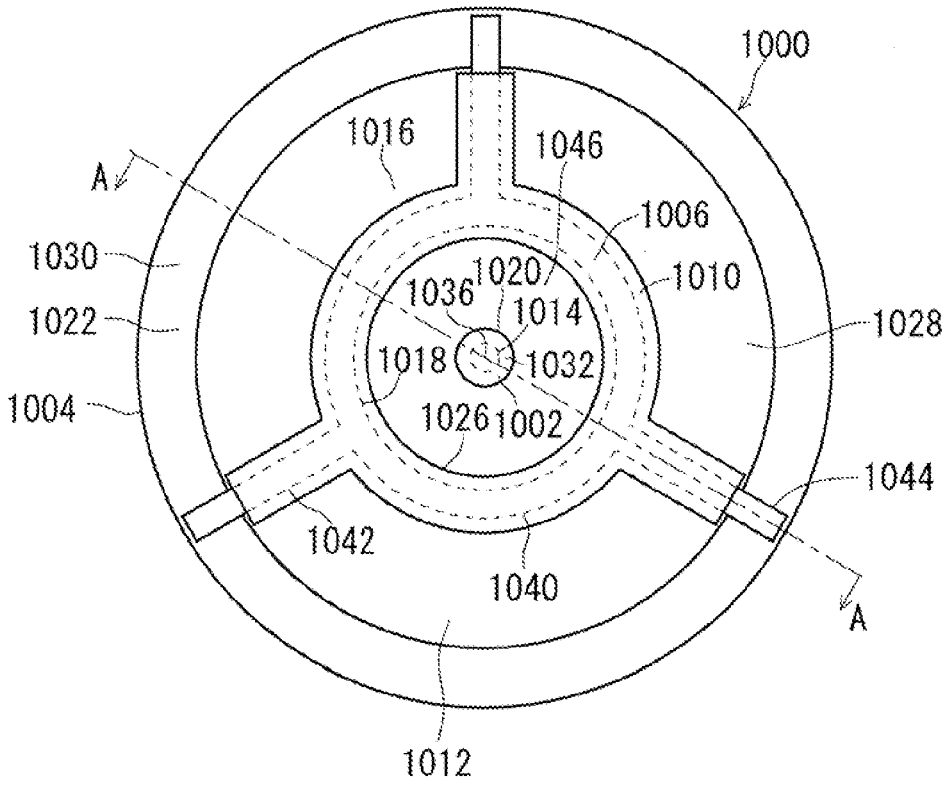
FIG. 2 is a top view illustrating the electrode structure according to the first embodiment.
Figure 3:
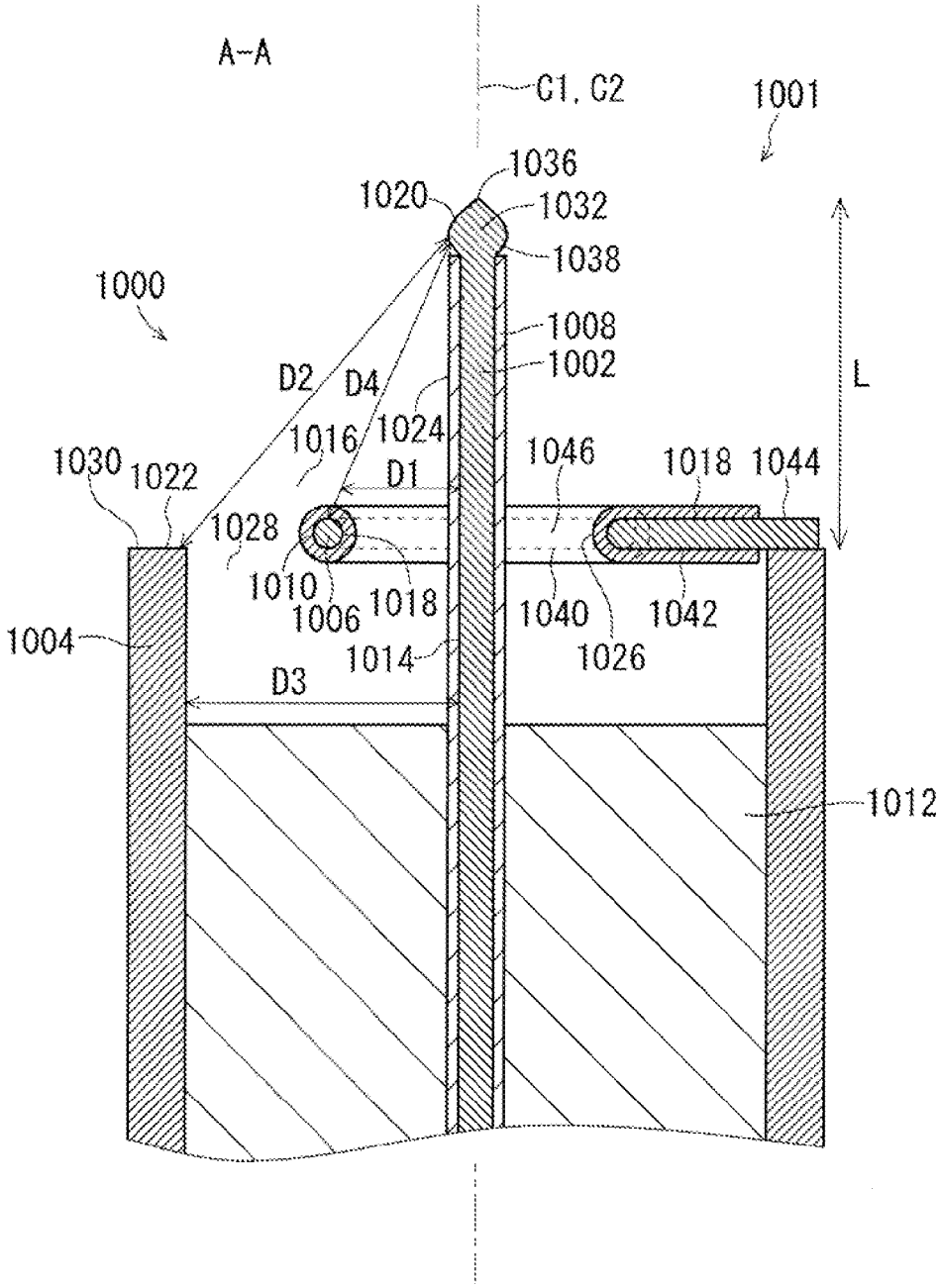
FIG. 3 is a cross-sectional view illustrating the electrode structure according to the first embodiment.

FIG. 1, FIG. 2, and FIG. 3 are schematic diagrams illustrating an electrode structure 1000 according to the first embodiment. FIG. 1 is a perspective view, FIG. 2 is a top view, and FIG. 3 is a cross-sectional view taken along line A-A in FIG. 2.

As shown in FIG. 1, FIG. 2, and FIG. 3, the electrode structure 1000 has an anode 1002, a cathode 1004, an auxiliary electrode 1006, an anode coating 1008, an auxiliary electrode coating 1010, and an anode supporting body 1012. The electrode structure 1000 is mounted to a combustion bomb formed with a combustion space 1016 similarly to a conventional spark plug, and a front end 1001 of the electrode structure 1000 is exposed in the combustion space 1016. The anode 1002 may be used as the cathode, and the cathode 1004 may be used as the anode.

(Relationship Between Distances D1 and D2)

A distance D1 from a coated surface 1014 of the anode 1002 to a coated surface 1018 of the auxiliary electrode 1006 via the anode coating 1008, the combustion space 1016, and the auxiliary electrode coating 1010 is shorter than a distance D2 from an exposed surface 1020 of the anode 1002 to an exposed surface 1022 of the cathode 1004 via the combustion space 1016 (D1<D2; see FIG. 3). According to the relationship between the discharge distances D1 and D2, discharge is generated relatively easily between the coated surface 1014 of the anode 1002 and the coated surface 1018 of the auxiliary electrode 1006, and the discharge is generated with relative difficulty between the exposed surface 1020 of the anode 1002 and the exposed surface 1022 of the cathode 1004. Therefore, when a voltage is applied between the anode 1002 and the cathode 1004, after a pre discharge is generated between the coated surface 1014 of the anode 1002 and the coated surface 1018 of the auxiliary electrode 1006, the main discharge is generated between the exposed surface 1020 of the anode 1002 and the exposed surface 1022 of the cathode 1004. As a result, even when the exposed surface 1020 of the anode 1002 is separated from the exposed surface 1022 of the cathode 1004, the main discharge is easily generated, and the main discharge becomes stable, thereby stably generating the discharge spreading widely and three-dimensionally. When the discharge spreads widely and three-dimensionally, a space that contributes to ignition becomes larger. Moreover, a flame kernel becomes large, active species increase, a combustion speed becomes fast, and a dilution limit is improved. Further, a position of the ignition reaches a center of the combustion space 1016. When the discharge is stably generated, even if a waveform of the voltage to be applied between the anode 1002 and the cathode 1004, of a composition and a pressure of the fuel-air mixture filling the combustion space 1016 slightly change, a form of the discharge does not greatly change, and a stable ignition is enabled.

(Subsistent between Electrodes and Form of Discharge)

A surface 1024 of the anode coating 1008 and a surface 1026 of the auxiliary electrode coating 1010 are exposed in the combustion space 1016. As a result, the coated surface 1014 of the anode 1002 is opposed to the coated surface 1018 of the auxiliary electrode 1006 with the anode coating 1008, the combustion space 1016, and the auxiliary electrode coating 1010 therebetween. This contributes to generation of dielectric-barrier discharge between the coated surface 1014 of the anode 1002 and the coated surface 1018 of the auxiliary electrode 1006.

The surface 1026 of the auxiliary electrode coating 1010 can be seen through from the surface 1024 of the anode coating 1008, and when the anode coating 1008 and the auxiliary electrode coating 1010 are not present, the coated surface 1018 of the auxiliary electrode 1006 can be seen through and/or from the coated surface 1014 of the anode 1002.

The exposed surface 1020 of the anode 1002 and the exposed surface 1022 of the cathode 1004 are exposed in the combustion space 1016. As a result, the exposed surface 1020 of the anode 1002 is opposed to the exposed surface 1022 of the cathode 1004 with the combustion space 1016 therebetween. This contributes to generation of non-dielectric-barrier discharge between the exposed surface 1020 of the anode 1002 and the exposed surface 1022 of the cathode 1004.

The exposed surface 1022 of the cathode 1004 can be seen through and/or from the exposed surface 1020 of the anode 1002.

In general, when the exposed surface of one electrode is opposed to the exposed surface of another electrode without a dielectric barrier therebetween, an abrupt arc discharge is easily generated, and the discharge is not stable. However, in the electrode structure 1000, a pre discharge is generated and a voltage for generating a streamer discharge between the exposed surface 1020 of the anode 1002 and the exposed surface 1022 of the cathode 1004 is lowered. A difference between the voltage for generating the streamer discharge and a voltage for generating the arc discharge becomes large, and thus the discharge is stabilized. Further, the arc discharge that damages the anode coating 1008 or the like becomes unlikely to be generated. When the arc discharge is unlikely to be generated, a specific structure is not forced in order to prevent the generation of the arc discharge, and thus a room for a deformation of the structure increases. Further, the factors that increase power consumption are reduced, and thus the power consumption is reduced.

(Transition of Discharge Form)

Figure 4:
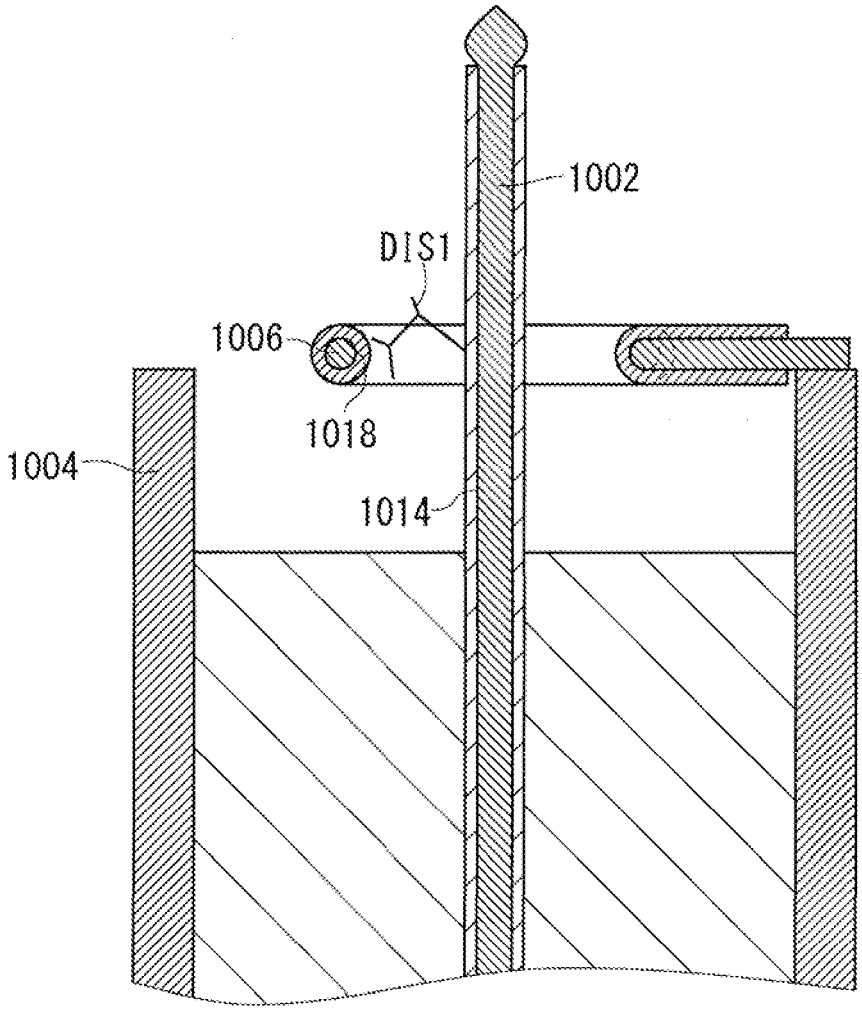
FIG. 4 is a schematic diagram describing a transition example of a discharge form.
Figure 5:
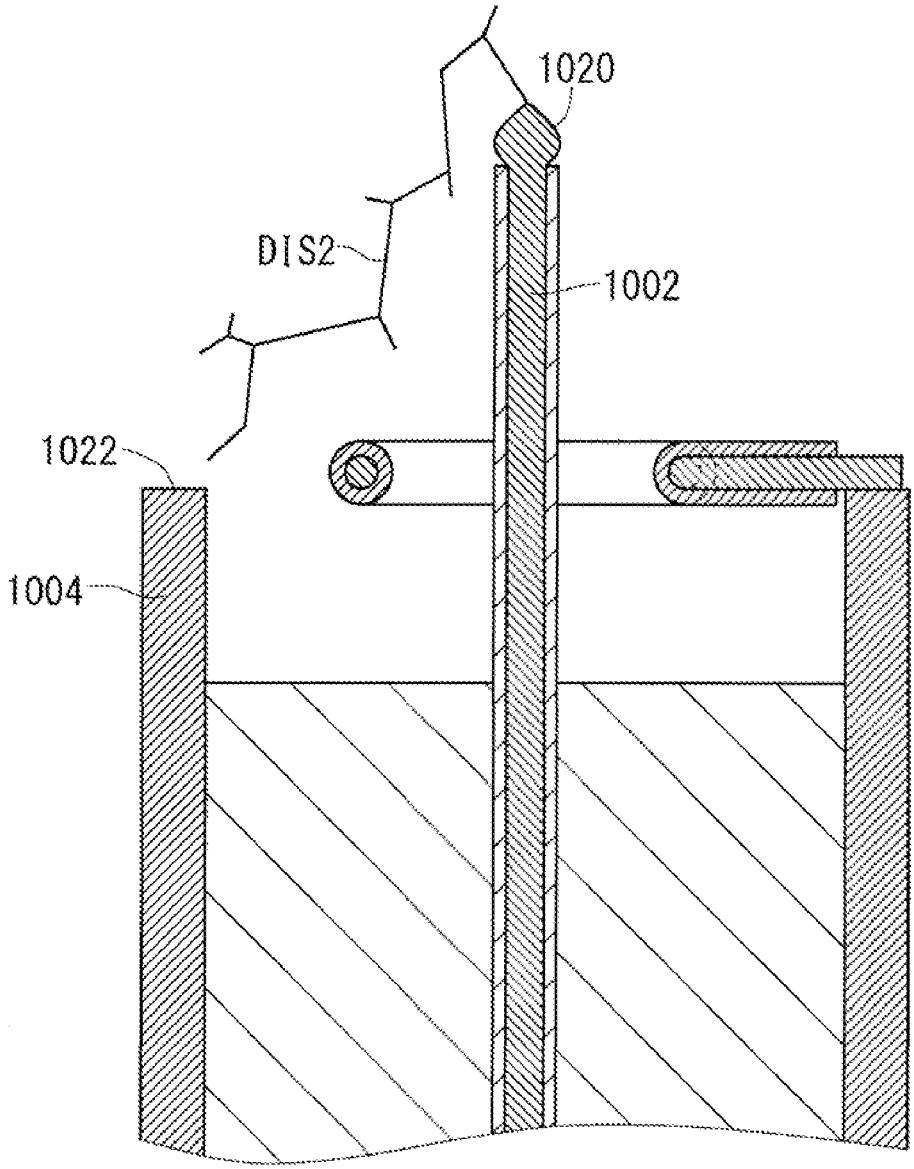
FIG. 5 is a schematic diagram describing a transition example of a discharge form.
Figure 6:
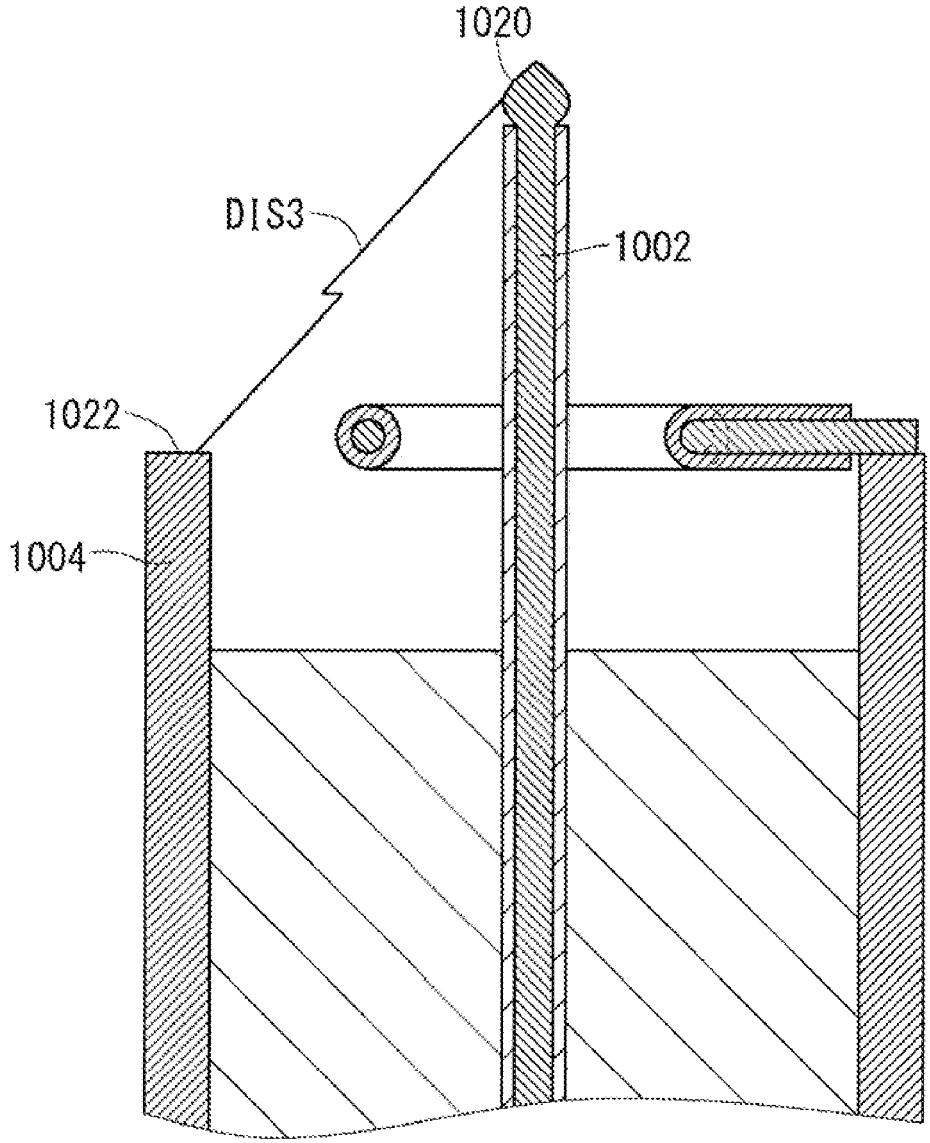
FIG. 6 is a schematic diagram describing a transition example of a discharge form.

FIG. 4, FIG. 5, and FIG. 6 are schematic diagrams (cross-sectional views) for describing a transition example of a discharge form. When a voltage is applied between the anode 1002 and the cathode 1004, as shown in FIG. 4, a pre discharge that mainly includes streamer discharge DIS1 is generated between the coated surface 1014 of the anode 1002 and the coated surface 1018 of the auxiliary electrode 1006 whose space distance is comparatively short. Thereafter, as shown in FIG. 5, main discharge that mainly includes streamer discharge DIS2 is generated between the exposed surface 1020 of the anode 1002 and the exposed surface 1022 of the cathode 1004 whose space distance is comparatively long. When the voltage to be applied is further heightened, as shown in FIG. 6, the main discharge may develop into discharge DIS3 whose form is different from the streamer discharge DIS1. The transition of the discharge format may be slightly different from those in FIG. 4, FIG. 5, and FIG. 6 according to a waveform or the like of the voltage to be applied, but even in this case, an advantage of the electrode structure 1000 is such that a stable discharge spreading widely and three-dimensionally is generated and is basically maintained.

(Outline of Anode 1002)

Referring back to FIG. 1, FIG. 2, and FIG. 3, the anode 1002 has a straight bar shape, and protrudes from an opening 1028 of the cathode 1004. As a result, the exposed surface 1020 of the anode 1002 is separated from an outer edge 1030 of the opening 1028 of the cathode 1004, and the main discharge spreads widely and three-dimensionally. A protrusion length L of the anode 1002 from the opening 1028 of the cathode 1004 is adjusted according to specifications of an internal combustion engine. For example, when the spread of the discharge is considered particularly important, the protrusion length L is increased, and otherwise, the protrusion length L is decreased. The electrode structure 1000 has an advantage such that a change in the specifications of the internal combustion engine can be coped with by a change in the protrusion length L.

(Coated Surface 1014 and Exposed Surface 1020 of Anode 1002)

The coated surface 1014 of the anode 1002 is coated with the anode coating 1008, but the exposed surface 1020 of the anode 1002 is not coated with the anode coating 1008 and is exposed in the combustion space 1016. The anode coating 1008 functions as a dielectric barrier. The surface of the anode 1002 includes both the coated surface 1014 and the exposed surface 1020, and the anode coating 1008 partially coats the surface of the anode 1002.

The exposed surface 1020 of the anode 1002 is positioned at a front end 1032 of the anode 1002 separated from the exposed surface 1022 of the cathode 1004. However, as long as the distance D1 is shorter than the distance D2 and the exposed surface 1020 of the anode 1002 is opposed to the exposed surface 1022 of the cathode 1004 with the combustion space 1016 therebetween, the exposed surface 1020 of the anode 1002 may be present in addition to the front end 1032 of the anode 1002.

(Structure of Anode 1002)

The front end 1032 of the anode 1002 has a teardrop shape, and the anode 1002 other than the front end 1032 has a round-bar shape.

The exposed surface 1020 of the anode 1002 has an apex 1036. As a result, an electric field concentrates on the apex 1036, and thus main discharge is easily generated.

The apex 1036 faces a direction where the anode 1002 extends and a direction separating from the exposed surface 1022 of the cathode 1004. As a result, as shown in FIG. 5, the main discharge develops towards the direction separating from the exposed surface 1022 of the cathode 1004, and the main discharge spreads widely. However, when the wide spreading of the main discharge is allowed to slightly reduce, the apex 1036 may face a direction other than that direction.

A portion 1038 on the exposed surface 1020 of the anode 1002, which is opposed to the exposed surface 1022 of the cathode 1004, has a convex curve. As a result, the durability of the anode 1002 is improved. This is because when the anode 1002 is worn out, curvature of the front end 1032 becomes small and thus the main discharge is easily generated, thereby making a disturbance of the generation of the main discharge difficult due to the wear of the anode 1002.

The anode 1002 other than the front end 1032 may have a shape other than the round-bar shape, but having the round-bar shape contributes to uniformness of the distance D1, with a reduction in a sharp portion on which the electric field concentrates, and an improvement in the uniformity of the pre discharge.

(Another Example of Structure of Front End of Anode)

Figure 7:
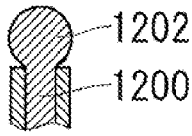
FIG. 7 is a cross-sectional view illustrating another example of a front end structure of an anode according to the first embodiment.
Figure 8:
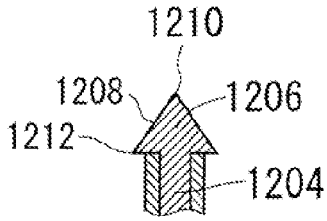
FIG. 8 is a cross-sectional view illustrating another example of a front end structure of an anode according to the first embodiment.
Figure 9:
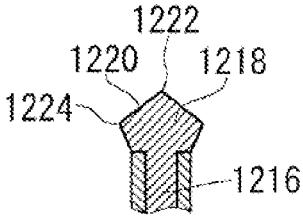
FIG. 9 is a cross-sectional view illustrating another example of a front end structure of an anode according to the first embodiment.

Instead of the anode 1002 whose front end 1032 has the teardrop shape, an anode whose front end has a shape other than the teardrop shape may be used. Examples of such an anode include an anode 1200 whose front end 1202 has a spherical shape shown in a schematic diagram (a cross-sectional view) of FIG. 7, an anode 1204 whose front end 1206 has a conical shape shown in a schematic diagram (a cross-sectional view) of FIG. 8, and an anode 1216 whose front end 1218 has a combined shape of a conical shape and a circular truncated cone shape shown in a schematic diagram (a cross-sectional view) of FIG. 9. An exposed surface 1208 of the anode 1204 has apexes 1210 and 1212, and the apex 1210 faces a direction where the anode 1204 extends and a direction separating from the exposed surface 1022 of the cathode 1004. The exposed surface 1220 of the anode 1216 has apexes 1222 and 1224, and the apex 1222 faces a direction where the anode 1216 extends and a direction separating from the exposed surface 1022 of the cathode 1004.

(Exposed Surface 1022 of Cathode 1004)

Referring back to FIG. 1, FIG. 2, and FIG. 3, a start point or an end point of the main discharge in the cathode 1004 having a tubular shape is mainly the outer edge 1030 of the opening 1028 of the cathode 1004, that is close to the exposed surface 1020 of the anode 1002. Therefore, at least the outer edge 1030 of the opening 1028 of the cathode 1004 on the surface of the cathode 1004 should be the exposed surface 1022 exposed in the combustion space 1016. The surface of the cathode 1004 other than the outer edge 1030 of the opening 1028 of the cathode 1004 may be the exposed surface 1022 or the coated surface coated with a dielectric body.

(Another Example of Cathode Structure)

Figure 10:
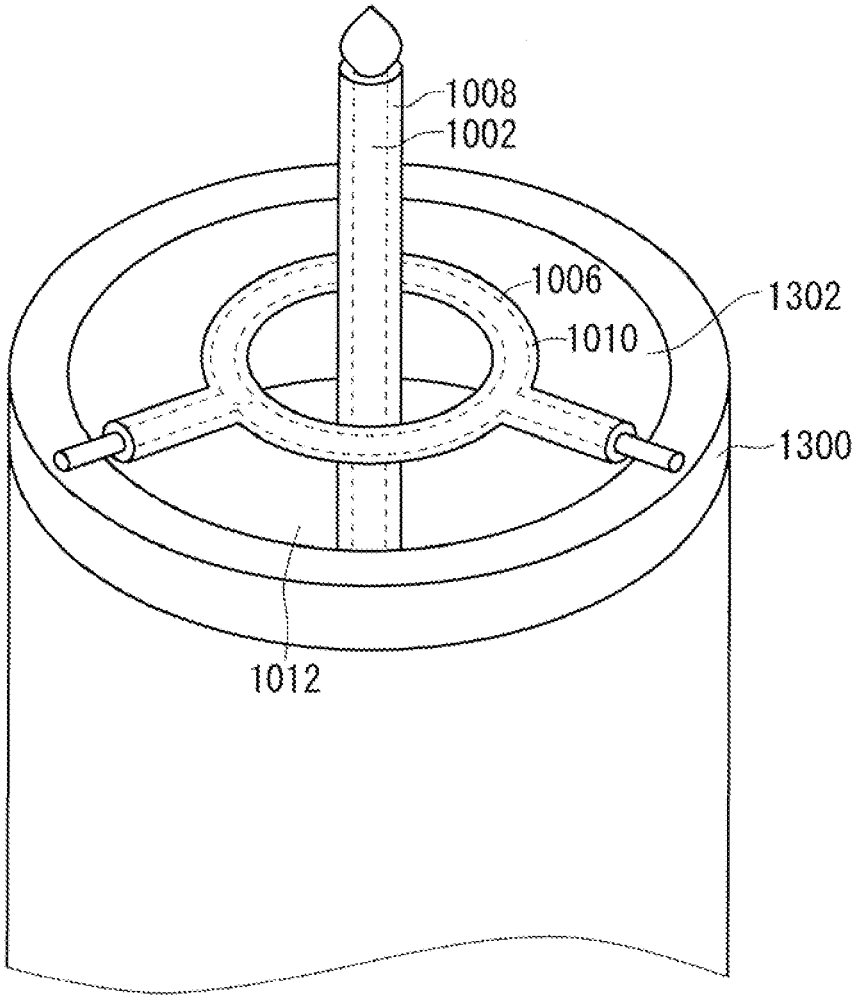
FIG. 10 is a perspective view illustrating another example of a cathode structure according to the first embodiment.

Instead of the cathode 1004 that is formed with the opening 1028 and has a tubular shape, a cathode that is formed with an opening but has a shape other than the tubular shape may be used. For example, a cathode 1300 that is formed with an opening 1302 having a circular shape and has a ring shape (loop shape) shown in a schematic diagram (a top view) of FIG. 10 may be used.

The opening 1028 of the cathode 1004 has a circular shape. As a result, when the anode 1002 is arranged at a center of the opening 1028 of the cathode 1004, the distance D2 becomes uniform, and the main discharge is generated uniformly. However, when the uniformity of the main discharge is allowed to be slightly deteriorated, a cathode that is formed with an opening having a shape other than the circular shape may be used. For example, a cathode 1304 that is formed with an opening 1306 having a square shape and has a tubular shape shown in a schematic diagram (a top view) of FIG. 11 may be used.

(Structure of Auxiliary Electrode 1006)

Referring back to FIG. 1, FIG. 2, and FIG. 3, the auxiliary electrode 1006 is provided with a discharge part 1040 having a ring shape and a connecting part 1042 having a straight bar shape. The connecting part 1042 extends from the discharge part 1040 radially towards an outside of a radial direction and reaches the outer edge 1030 at the opening 1028 of the cathode 1004. The discharge part 1040 is smaller than the opening 1028 of the cathode 1004 and is housed in the opening 1028 of the cathode 1004 viewed from the extended direction of the anode 1002.

(Coated Surface 1018 and Exposed Surface 1044 of Auxiliary Electrode 1006)

The coated surface 1018 of the auxiliary electrode 1006 other than the front end of the connecting part 1042 is coated with the auxiliary electrode coating 1010. However, the exposed surface 1044 at the front end of the connecting part 1042 is not coated with the auxiliary electrode coating 1010 and is connected to the outer edge 1030 at the opening 1028 of the cathode 1004. As a result, the auxiliary electrode 1006 is connected to the cathode 1004, and the auxiliary electrode 1006 is supported by the cathode 1004.

At least the coated surface 1018 is present on the surface of the auxiliary electrode 1006, but the exposed surface 1044 may be present thereon, and the auxiliary electrode coating 1010 entirely or partially coats the surface of the auxiliary electrode 1006. The auxiliary electrode coating 1010 functions as a dielectric barrier.

An opening 1046 formed on the discharge part 1040 has a circular shape. As a result, when the anode 1002 is arranged at the center of the opening 1046, the distance D1 becomes uniform, and thus a pre discharge is generated uniformly.

(Another Example of Auxiliary Electrode Structure)

Figure 12:
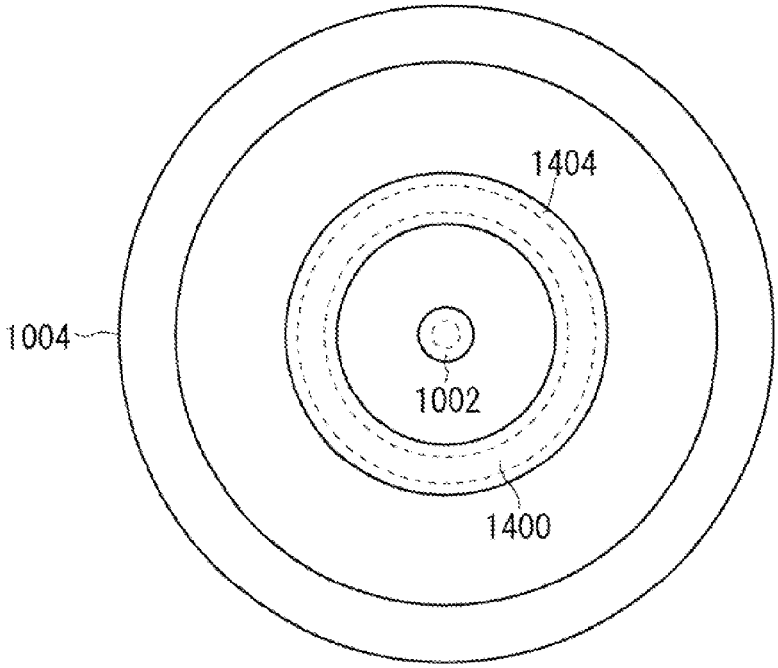
FIG. 12 is a top view illustrating another example of the auxiliary electrode structure according to the first embodiment.

The connecting part 1042 is provided and its front end is used as the exposed surface 1044 in order that the auxiliary electrode 1006 is electrically connected to the cathode 1004. However, it is not essential that the auxiliary electrode is electrically connected to the cathode 1004, and the auxiliary electrode may be a floating electrode that is not electrically connected to the cathode 1004. Therefore, instead of the auxiliary electrode 1006, an auxiliary electrode 1400 having a ring shape in which a connecting part is omitted as shown in a schematic diagram (a top view) of FIG. 12 may be used. When the auxiliary electrode 1400 is used, the auxiliary electrode 1400 is supported by the anode supporting body or another supporting body instead of the cathode 1004. The entire surface of the auxiliary electrode 1400 is coated with an auxiliary electrode coating 1404.

Further, when the uniformity of the pre discharge is allowed to be slightly deteriorated, an auxiliary electrode other than the auxiliary electrode 1006 having the discharge part 1040 formed with the opening 1046 having the circular shape is also used.

Figure 13:
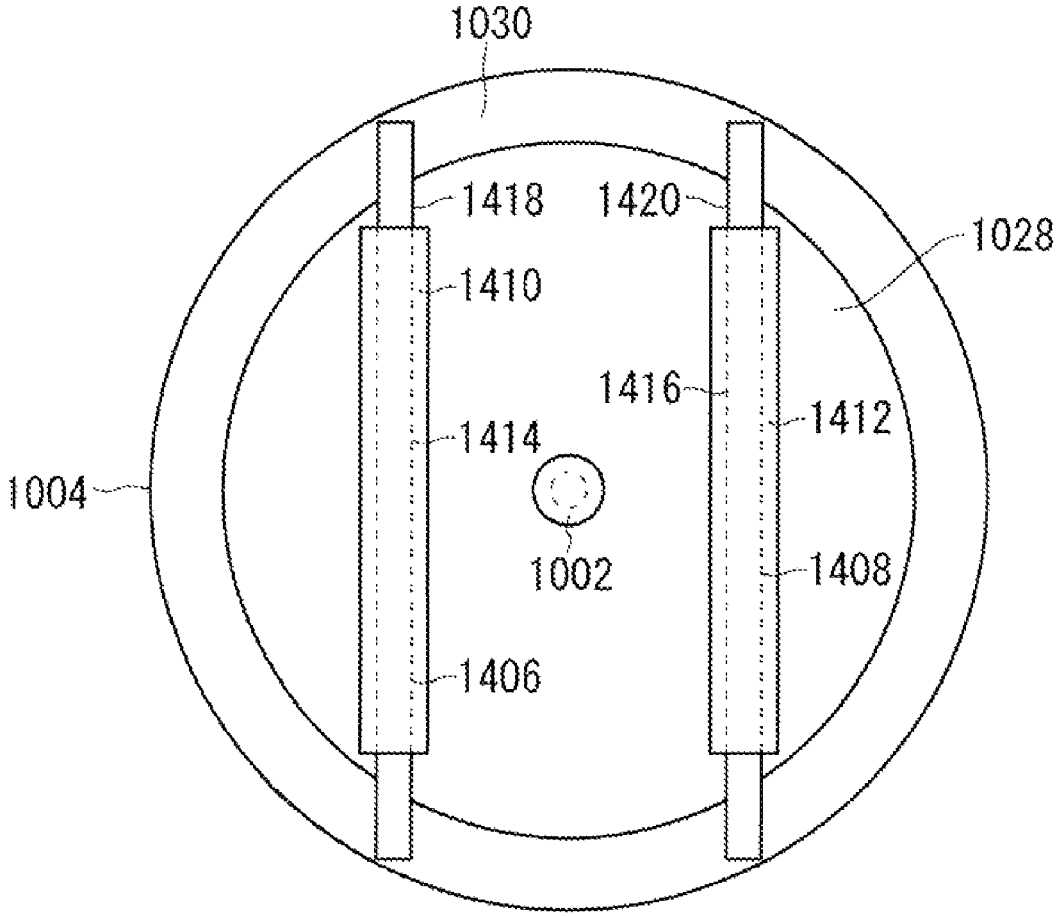
FIG. 13 is a top view illustrating another example of the auxiliary electrode structure according to the first embodiment.

For example, a set of auxiliary electrodes 1406 and 1408 having a straight-bar shape may be used as shown in a schematic diagram (a top view) of FIG. 13. The surfaces of the auxiliary electrodes 1406 and 1408 are partially coated with the auxiliary electrode coatings 1410 and 1412, respectively, and coated surfaces 1414 and 1416 are present at centers of the auxiliary electrodes 1406 and 1408, respectively. Exposed surfaces 1418 and 1420 are present on both ends of the auxiliary electrodes 1406 and 1408, respectively. Exposed surfaces 1418 and 1420 are connected to the outer edge 1030 of the opening 1028 of the cathode 1004. As a result, the auxiliary electrodes 1406 and 1408 are electrically connected to the cathode 1004, and the auxiliary electrodes 1406 and 1408 are supported by the cathode 1004. The auxiliary electrodes 1406 and 1408 are arranged in parallel. As a result, when the anode 1002 is arranged at a center of a gap between the auxiliary electrodes 1406 and 1408, the distance D1 becomes uniform, and the pre discharge is uniformly generated. When the uniformity of the pre discharge is allowed to be slightly deteriorated, the auxiliary electrodes 1406 and 1408 may be arranged in non-parallel.

Figure 14:
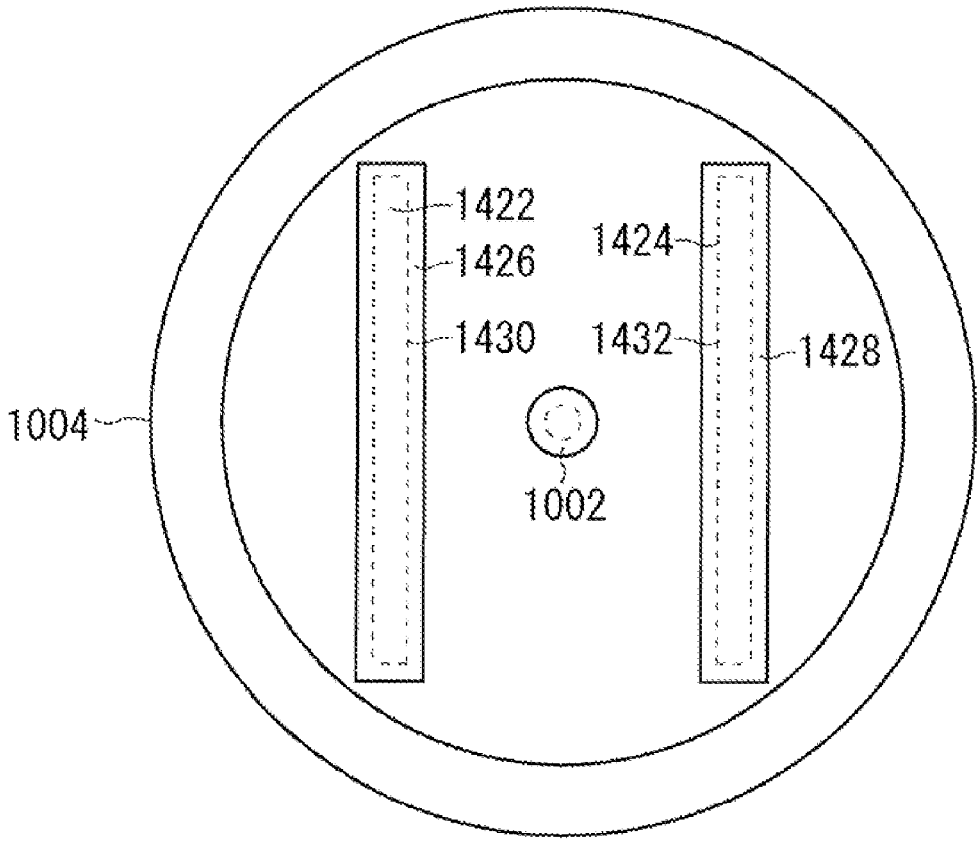
FIG. 14 is a top view illustrating another example of the auxiliary electrode structure according to the first embodiment.

Further, as shown in a schematic diagram (a top view) of FIG. 14, a set of auxiliary electrodes 1422 and 1424 having a straight-bar shape may be used. The entire surfaces of the auxiliary electrodes 1422 and 1424 are coated with auxiliary electrode coatings 1426 and 1428, respectively, and the auxiliary electrodes 1422 and 1424 have coated surfaces 1430 and 1432, respectively, but do not have exposed surfaces. The auxiliary electrodes 1422 and 1424 are supported by the anode supporting body or another supporting body. The auxiliary electrodes 1422 and 1424 are arranged in parallel. As a result, when the anode 1002 is arranged at a center of a gap between the auxiliary electrodes 1422 and 1424, the distance D1 becomes uniform, and the pre discharge is uniformly generated. However, when the uniformity of the pre discharge is allowed to be slightly deteriorated, the auxiliary electrodes 1422 and 1424 may be arranged in non-parallel.

It is not essential that the set of the auxiliary electrodes include two auxiliary electrodes, and thus the set is allowed to include three or more auxiliary electrodes.

Figure 11:
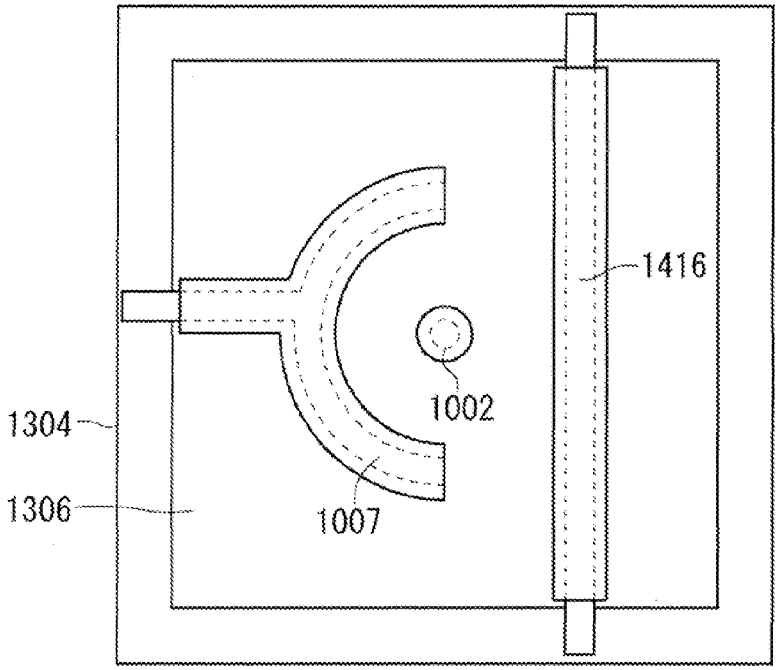
FIG. 11 is a top view illustrating another examples of a cathode structure and an auxiliary electrode structure according to the first embodiment.

Further, as shown in a schematic diagram of FIG. 11, a part 1007 of the auxiliary electrode 1006 shown in FIG. 2 may be combined with an auxiliary electrode 1416 shown in FIG. 13.

(Arrangement of Anode 1002, Cathode 1004 and Auxiliary Electrode 1006)

Referring back to FIG. 1, FIG. 2, and FIG. 3, a central axis C1, that passes through the center of the opening 1028 of the cathode 1004 and is perpendicular to the opening 1028, coexists with a central axis C2, that passes through a center of the opening 1046 of the discharge part 1040 of the auxiliary electrode 1006 and is perpendicular to the opening 1046. The anode 1002 is arranged coaxially on the central axes C1 and C2 by a solid anode supporting body 1012 made of an insulator (a dielectric body). As a result, the distances D1 and D2 become uniform, a shift between a position where the pre discharge is generated and a position where the main discharge is generated is reduced, and thus the pre discharge and the main discharge are uniformly generated. When the uniformity of the pre discharge and the main discharge is allowed to be slightly deteriorated, the central axis C1 and the central axis C2 may be shifted from each other, and the anode 1002 may be shifted from both or one of the central axes C1 and C2.

The discharge part 1040 is arranged at the center of the opening 1028 viewed from the extended direction of the anode 1002, and is present between the coated surface 1014 of the anode 1002 and the exposed surface 1022 of the cathode 1004. As a result, the distance D1 is shorter than a distance D3 from the coated surface 1014 of the anode 1002 to the exposed surface 1022 of the cathode 1004 via the anode coating 1008 and the combustion space 1016 (D1<D3; see FIG. 3). Thus, the disturbance of the pre discharge between the coated surface 1014 of the anode 1002 and the coated surface 1018 of the auxiliary electrode 1006 is reduced by the discharge between the coated surface 1014 of the anode 1002 and the outer edge 1030 of the opening 1028 of the cathode 1004.

Further, the coated surface 1014 of the anode 1002 passes through the opening 1046 of the auxiliary electrode 1006, and the auxiliary electrode 1006 is separated from the exposed surface 1020 of the anode 1002. As a result, the distance D1 is shorter than a distance D4 from the coated surface 1018 of the auxiliary electrode 1006 to the exposed surface 1020 of the anode 1002 via the auxiliary electrode coating 1010 and the combustion space 1016 (D1<D4; see FIG. 3). Thus, the disturbance of the pre discharge between the coated surface 1014 of the anode 1002 and the coated surface 1018 of the auxiliary electrode 1006 is reduced by the discharge between the exposed surface 1020 of the anode 1002 and the coated surface 1018 of the auxiliary electrode 1006.

The auxiliary electrode 1006 is provided to avoid a discharge path of the main discharge. As a result, the disturbance in the main discharge by means of the auxiliary electrode 1006 is reduced.

(Material)

Materials of the anode 1002, the cathode 1004 and the auxiliary electrode 1006 may be a conductor, and the materials are selected from, for example, nickel (Ni) base alloy, copper (Cu) base alloy, alloys such as tungsten (W), iridium (Ir), ruthenium (Ru), platinum (Pt) and yttrium (Y) and so on. The materials of the anode 1002, the cathode 1004, and the auxiliary electrode 1006 may be the same or different from each other.

It suffices if the material of the anode coating 1008 and the auxiliary electrode coating 1010 is a dielectric body, then the material is selected from, for example, ceramics such as alumina and resin, such as fluorine resin.

(Another Example of Electrode Structure)

Instead of the electrode structure 1000 where the anode 1002 protrudes from the opening 1028 of the cathode 1004, an electrode structure where the anode protrudes from a gap between two or more cathodes may be used.

Figure 15:
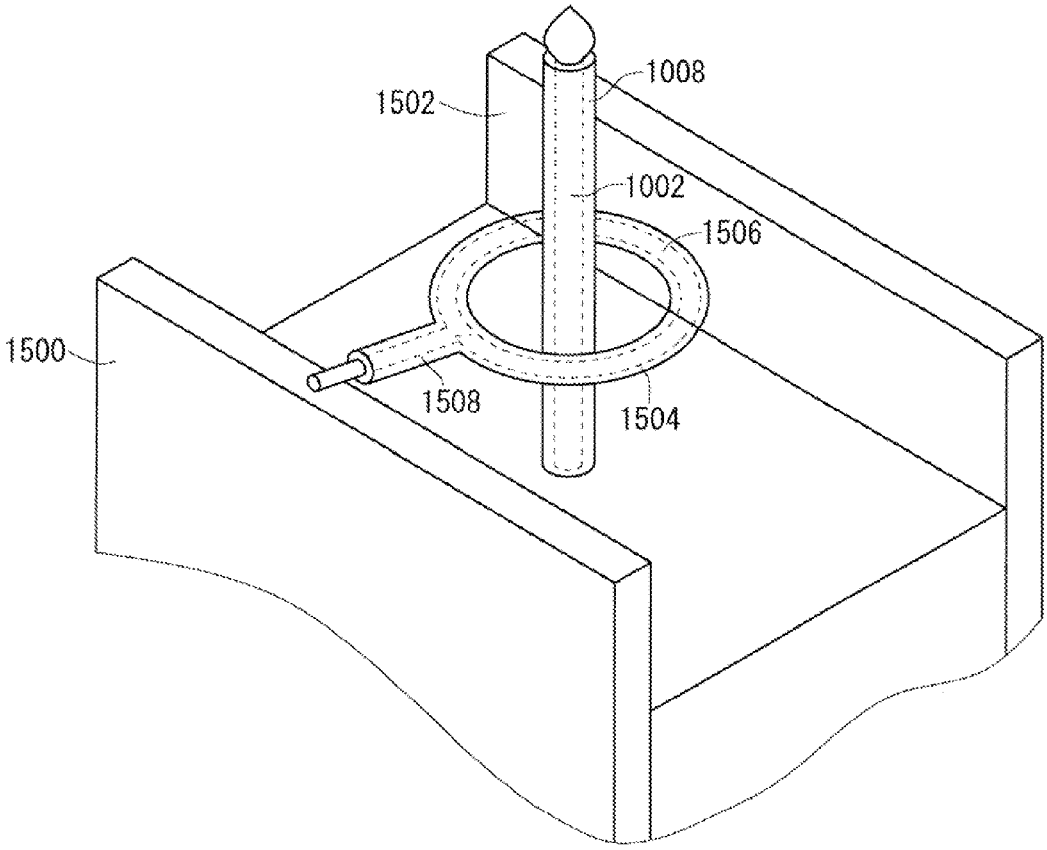
FIG. 15 is a perspective view illustrating another example of the electrode structure according to the first embodiment.

For example, as shown in a schematic diagram (a perspective view) of FIG. 15, an electrode structure in which the anode 1002 protrudes from a gap between a cathode 1500 having a plate shape and a cathode 1502 having a plate shape may be used. The cathodes 1500 and 1502 are arranged in parallel. As a result, when the anode 1002 is arranged at the center of the gap, the main discharge is uniformly generated. When the uniformity of the main discharge is allowed to be slightly deteriorated, the cathodes 1500 and 1502 may be arranged in non-parallel. FIG. 15 illustrates an auxiliary electrode 1504 provided with a discharge part 1506 having a ring shape and a connecting part 1508 having a straight-bar shape.

Figure 16:
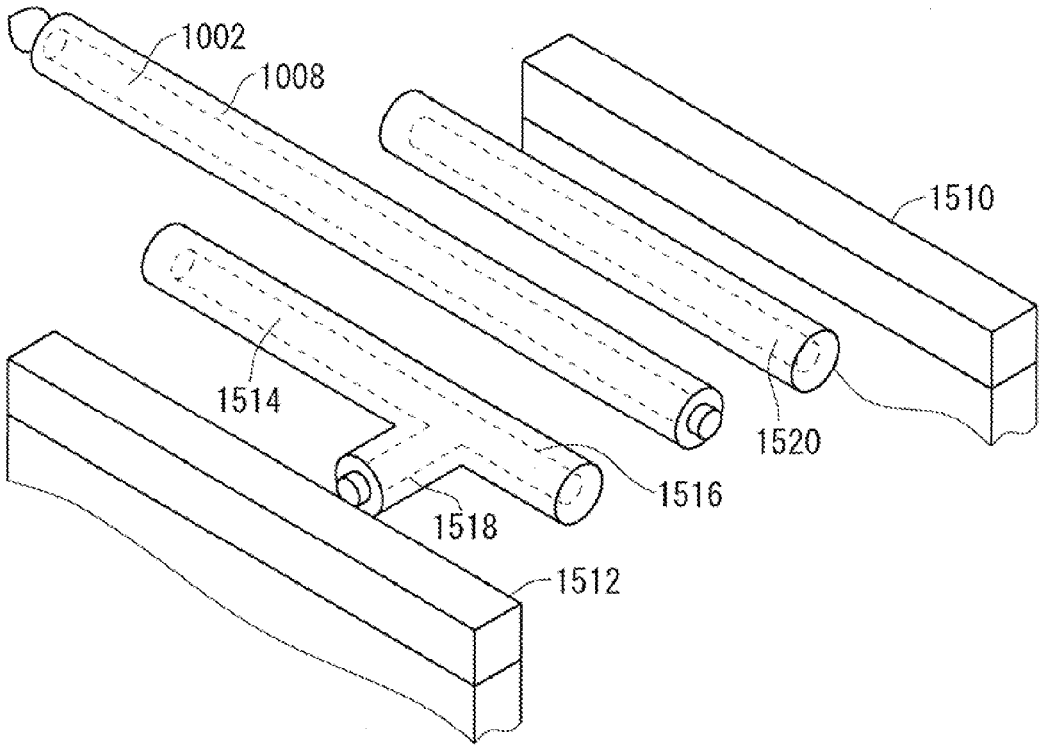
FIG. 16 is a perspective view illustrating another example of the electrode structure according to the first embodiment.

Further, as shown in a schematic diagram (a perspective view) of FIG. 16, an electrode structure in which the anode 1002 protrudes from a gap between a cathode 1510 having a straight-bar shape and a cathode 1512 having a straight-bar shape may be adopted. The cathodes 1510 and 1512 are arranged in parallel. As a result, when the anode 1002 is arranged at the center of the gap, the main discharge is uniformly generated. When the uniformity of the main discharge is allowed to be slightly deteriorated, the cathodes 1510 and 1512 may be arranged in non-parallel. FIG. 16 illustrates an auxiliary electrode 1514 having a discharge part 1516 with a straight-bar shape and a connecting part 1518 with a straight-bar shape, and an auxiliary electrode 1520 having a straight-bar shape.

(Verification of Stability of Discharge)

Figure 17:
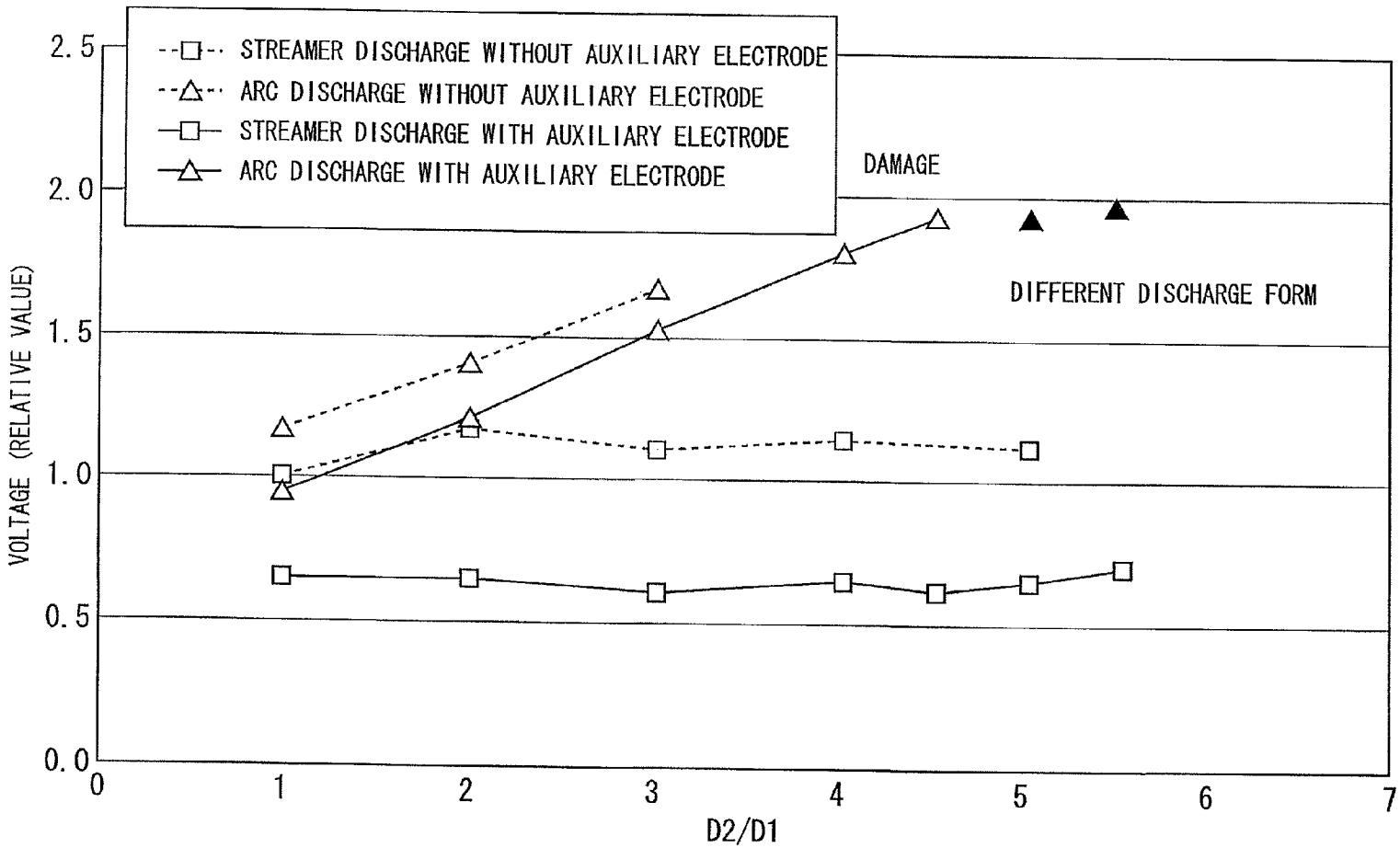
FIG. 17 is a diagram illustrating a verified result of stability of the discharge.

FIG. 17 is a diagram describing a verified result of the stability of the discharge. FIG. 17 is a graph showing changes in a voltage (rectangular plot) for generating an arc discharge and a voltage (square plot) for generating a streamer discharge according to a ratio D2/D1 of the distance D2 to the distance D1 in a case (solid line) where the auxiliary electrode is provided and a case (broken line) where the auxiliary electrode is not provided. The voltage is an relative value.

As shown in FIG. 17, when the auxiliary electrode is provided, the voltage for generating the streamer discharge is reduced further and thus a difference between the voltage for generating the arc discharge and the voltage for generating the streamer discharge becomes large in comparison with the case where the auxiliary electrode is not provided. This means that when the auxiliary electrode is provided, the main discharge is stable, and even if a composition and a pressure of an atmosphere filling the combustion space changes, the main discharge is stably generated. In the internal combustion engine, since the composition and the pressure of the fuel-air mixture filling the combustion space are not constant, this contributes to the stable ignition of the fuel-air mixture.

Further, when the auxiliary electrode is provided, even if the distance D2 becomes long, the anode is unlikely to be damaged. This means that when the auxiliary electrode is provided, the distance D2 is lengthened and thus the discharge spreading widely and three-dimensionally can be generated.

{Second Embodiment}

A second embodiment relates to an electrode structure of the ignition device for igniting the fuel-air mixture filling the combustion space of the internal combustion engine.

Figure 18:
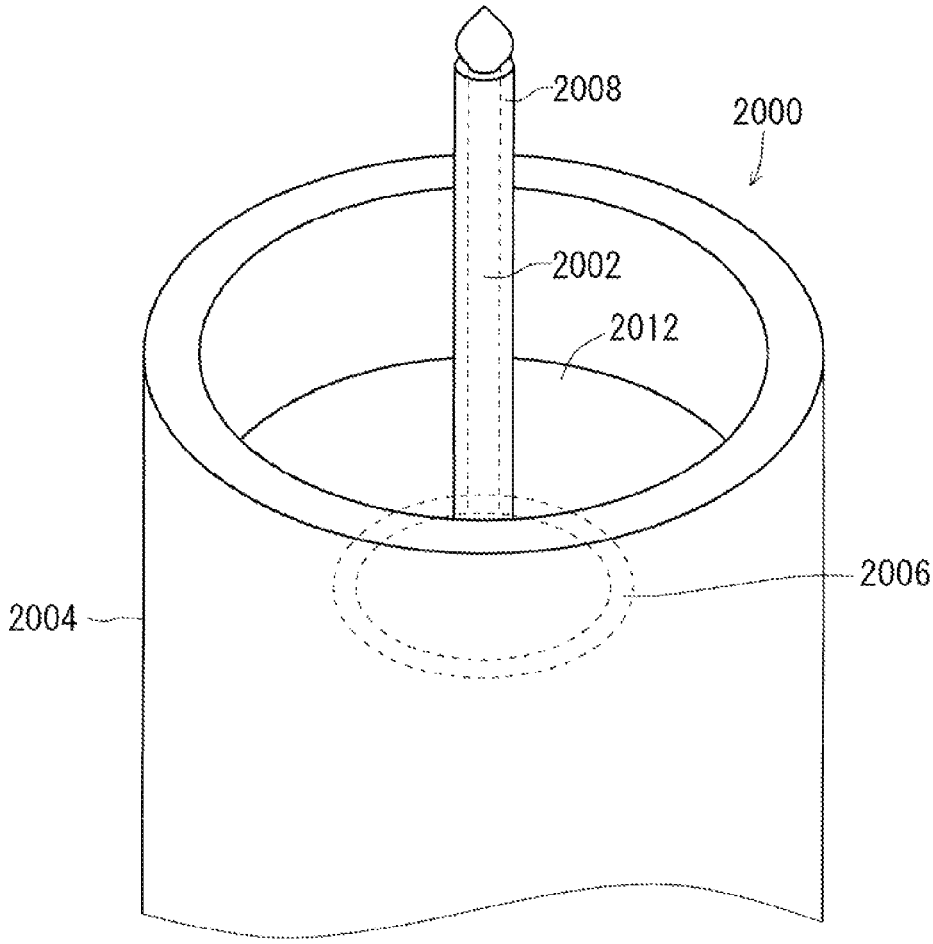
FIG. 18 is a perspective view illustrating the electrode structure according to a second embodiment.
Figure 19:
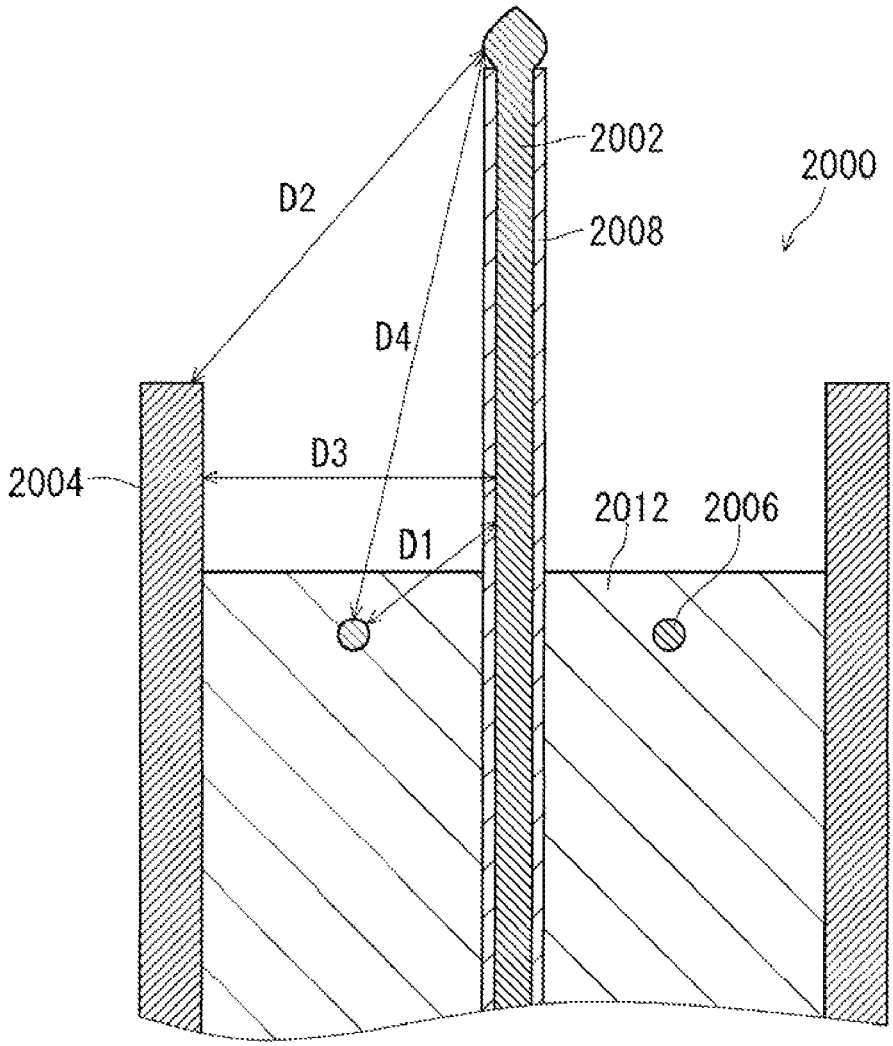
FIG. 19 is a cross-sectional view illustrating the electrode structure according to the second embodiment.

FIG. 18 and FIG. 19 are schematic diagrams illustrating an electrode structure 2000 according to the second embodiment. FIG. 18 is a perspective view, and FIG. 19 is a cross-sectional view.

As show in FIG. 18 and FIG. 19, the electrode structure 2000 includes an anode 2002, a cathode 2004, an auxiliary electrode 2006, an anode coating 2008, and an anode supporting body 2012. The anode 2002 may be used as the cathode, and the cathode 2004 may be used as the anode.

(Common Point and Different Point with Respect to Electrode Structure 1000 According to First Embodiment)

A first difference between the electrode structure 1000 according to the first preferred embodiment and the electrode structure 2000 according to the second preferred embodiment is that the auxiliary electrode 2006 is embedded into the anode supporting body 2012 and the auxiliary electrode coating is omitted in the electrode structure 2000. Further, a second difference is that the auxiliary electrode 2006 does not have a connecting part, the entire surface of the auxiliary electrode 2006 is coated with the anode supporting body 2012, and the auxiliary electrode 2006 is a floating electrode that is not connected to the cathode 2004. The anode supporting body 2012 functions as a dielectric barrier in place of the omitted auxiliary electrode coating.

A relationship among the distances D1, D2, D3, and D4 in the electrode structure 2000 is the same as the relationship among the distances D1, D2, D3, and D4 in the electrode structure 1000 (D1<D2, D1<D3, D1<D4; see FIG. 19). Therefore, also in the electrode structure 2000, when a voltage is applied between the anode 2002 and the cathode 2004, the discharge makes a transition similarly to the case of the electrode structure 1000.

Further, characteristics such as structures, arrangements, and materials of the anode 1002, the cathode 1004, the auxiliary electrode 1006, and the anode coating 1008 in the electrode structure 1000 can also be adopted in the electrode structure 2000.

{Third Embodiment}

(Outline)

A third embodiment relates to the electrode structure of the ignition device for igniting the fuel-air mixture filling the combustion space of the internal combustion engine.

Figure 20:
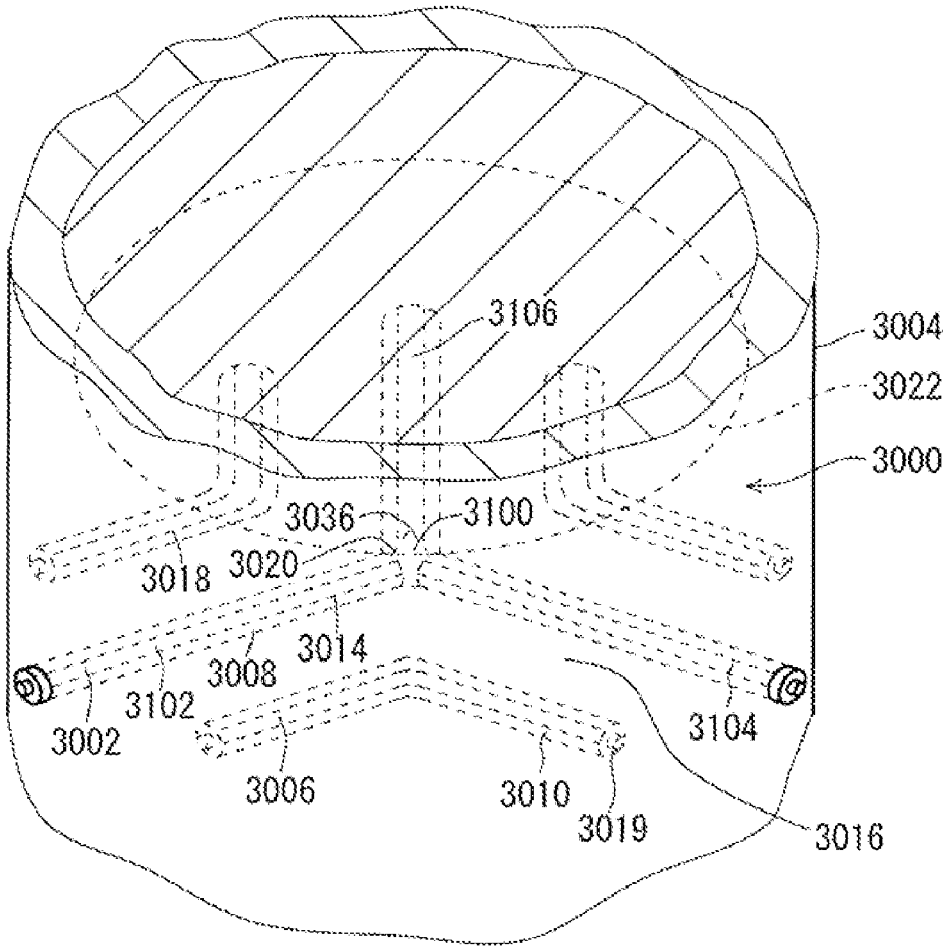
FIG. 20 is a perspective view illustrating a combustion bomb and the electrode structure according to a third embodiment.
Figure 21:
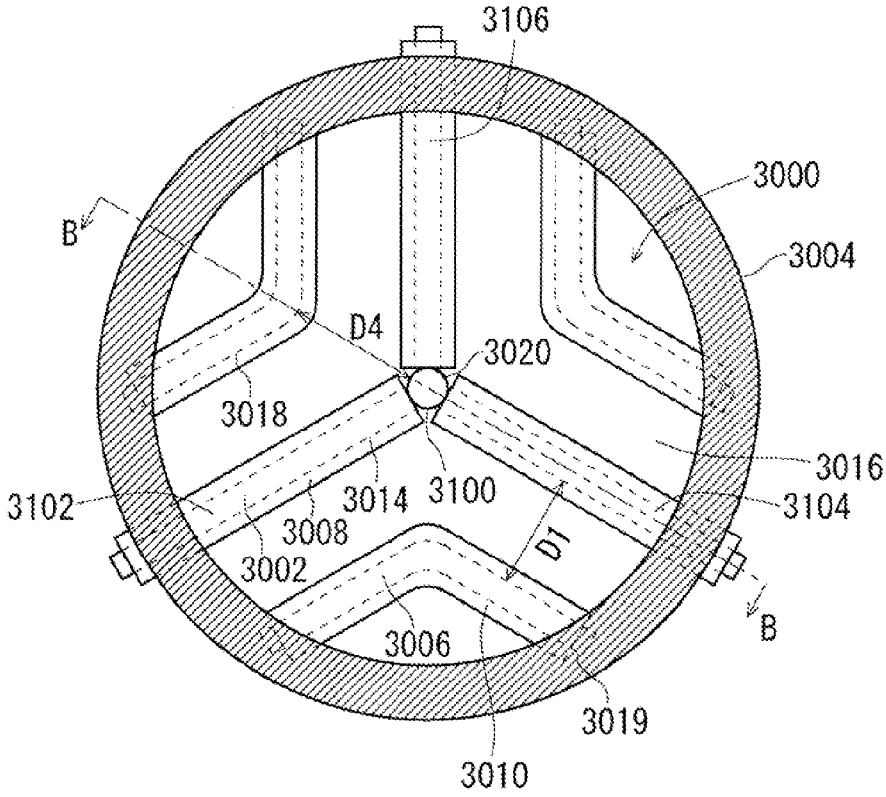
FIG. 21 is a transverse cross-sectional view illustrating the combustion bomb and the electrode structure according to the third embodiment.
Figure 22:
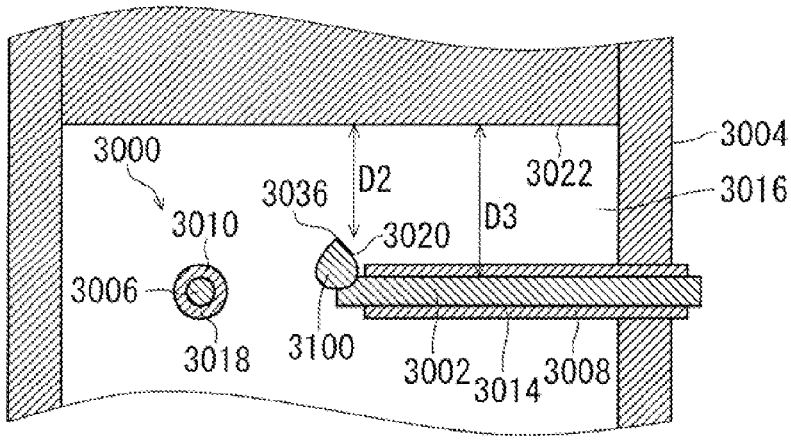
FIG. 22 is a vertical cross-sectional view illustrating the combustion bomb and the electrode structure according to the third embodiment.

FIG. 20, FIG. 21, and FIG. 22 are schematic diagrams illustrating a combustion bomb 3004 and an electrode structure 3000 according to the third embodiment. FIG. 20 is a perspective view, FIG. 21 is a transverse cross-sectional view, and FIG. 22 is a vertical cross-sectional view taken along line B-B of FIG. 21.

As shown in FIG. 20, FIG. 21, and FIG. 22, the electrode structure 3000 has an anode 3002, an auxiliary electrode 3006, an anode coating 3008, and an auxiliary electrode coating 3010. Main parts of the electrode structure 3000 are housed in a combustion space 3016 formed in the combustion bomb 3004 made of a conductor. The combustion bomb 3004 is used instead of the cathode. The anode 3002 may be used as the cathode, and the combustion bomb 3004 may be used instead of the anode.

(Common Point with Respect to Electrode Structure 1000 According to First Embodiment)

A coated surface 3014 of the anode 3002 is opposed to a coated surface 3018 of the auxiliary electrode 3006 with the anode coating 3008, the combustion space 3016, and the auxiliary electrode coating 3010 therebetween, and an exposed surface 3020 of the anode 3002 is opposed to a piston head surface 3022 of an inner wall surrounding the combustion space 3016 with the combustion space 3016 therebetween. The relationship among the distances D1, D2, D3, and D4 in the electrode structure 3000 is the same as relationship among the distances D1, D2, D3, and D4 in the electrode structure 1000 (D1<D2, D1<D3, D1<D4; see FIG. 21 and FIG. 22). The distance D1 is a distance from the coated surface 3014 of the anode 3002 to the coated surface 3018 of the auxiliary electrode 3006 via the anode coating 3008, the combustion space 3016, and the auxiliary electrode coating 3010. The distance D2 is a distance from the exposed surface 3020 of the anode 3002 to the piston head surface 3022 via the combustion space 3016. The distance D3 is a distance from the coated surface 3014 of the anode 3002 to the piston head surface 3022 via the anode coating 3008 and the combustion space 3016. The distance D4 is a distance from the coated surface 3018 of the auxiliary electrode 3006 to the exposed surface 3020 of the anode 3002 via the auxiliary electrode coating 3010 and the combustion space 3016. Therefore, also in the electrode structure 3000, when a voltage is applied between the anode 3002 and the combustion bomb 3004, the discharge makes a transition similarly to the case of the electrode structure 1000.

The characteristics such as the structures, the arrangements, and the materials of the anode 1002, the auxiliary electrode 1006, the anode coating 1008, and the auxiliary electrode coating 1010 in the electrode structure 1000 can also be adopted also in the electrode structure 3000.

Since the piston head surface 3022 is a movable surface, the distances D2 and D3 vary according to timing, but the above relationship among the distances D1, D2, D3, and D4 may be established at the timing where the pre discharge is generated, and does not always have to be established at timing other than the timing where the pre discharge is generated. For example, after the pre discharge is generated, the piston head surface 3022 comes close to the electrode structure 3000, and the above relationship among the distances D1, D2, D3, and D4 does not have to be established. In place of generating discharge between the piston head surface 3022 and the electrode structure 3000, the discharge may be generated between an immovable surface other than the piston head surface 3022 and the electrode structure 3000.

(Anode 3002)

The anode 3002 has a structure that three branches 3102, 3104, and 3106 having a bar shape extend radially from a branching part 3100. The three branches 3102, 3104, and 3106 are in the same plane and form a uniform angle.

The coated surface 3014 of the anode 3002 is coated with the anode coating 3008, but the exposed surface 3020 of the anode 3002 is not coated with the anode coating 3008 and is exposed in the combustion space 3016. The anode coating 3008 functions as a dielectric barrier. Both the coated surface 3014 and the exposed surface 3020 are present on the surface of the anode 3002, and the anode coating 3008 partially coats the surface of the anode 3002.

The exposed surface 3020 of the anode 3002 is present on the branching part 3100 of the anode 3002. The exposed surface 3020 of the anode 3002 may be present on the anode 3002 other than the branching part 3100.

The branching part 3100 of the anode 3002 has the same structure as that of the front end 1032 of the anode 1002 according to the first embodiment.

An apex 3036 faces a direction approaching the piston head surface 3022. However, the apex 3006 may face another direction.

The branches 3102, 3104, and 3106 of the anode 3002 have a round-bar shape. As a result, a sharp portion where an electric field concentrates is reduced, and the pre discharge is uniformly generated. When the uniformity of the pre discharge is allowed to be slightly deteriorated, the branches 3102, 3104, and 3106 of the anode 3002 may have a shape other than the round-bar shape.

(Coated Surface 3018 and Exposed Surface 3019 of Auxiliary Electrode 3006)

The coated surface 3018 of the auxiliary electrode 3006 other than both ends of the auxiliary electrode 3006 having the bar shape is coated with the auxiliary electrode coating 3010, but the exposed surface 3019 at both ends of the auxiliary electrode 3006 is not coated with the auxiliary electrode coating 3010. The exposed surface 3019 is connected to the combustion bomb 3004. As a result, the auxiliary electrode 3006 is electrically connected to the combustion bomb 3004, and the auxiliary electrode 3006 is supported. At least the coated surface 3018 is present on the surface of the auxiliary electrode coating 3010, and the auxiliary electrode coating 3010 entirely or partially coats the surface of the auxiliary electrode 3006. The auxiliary electrode coating 3010 functions as a dielectric barrier.

Both the ends of the auxiliary electrode 3006 are made to be the exposed surface 3019 in order that the auxiliary electrode 3006 is electrically connected to the combustion bomb 3004. However, it is not essential that the auxiliary electrode 3006 is electrically connected to the combustion bomb 3004, and the auxiliary electrode 3006 may be a floating electrode that is not electrically connected to the combustion bomb 3004. Therefore, for this reason, the entire surface of the auxiliary electrode 3006 may be coated with the auxiliary electrode coating 3010.

(Arrangements of Anode 3002 and Auxiliary Electrode 3006)

The anode 3002 and the'auxiliary electrode 3006 are in the same plane. The auxiliary electrode 3006 is arranged along the branches 3102, 3104, and 3106 of the anode 3002 and in parallel with the branches 3102, 3104, and 3106 of the anode 3002. As a result, the distance D1 becomes uniform, and the pre discharge is uniformly generated. However, when the uniformity of the pre discharge is allowed to be slightly deteriorated, the auxiliary electrode 3006 does not have to be in parallel with the branches 3102, 3104, and 3106 of the anode 3002.

(Another Example of Electrode Structure)

Figure 23:
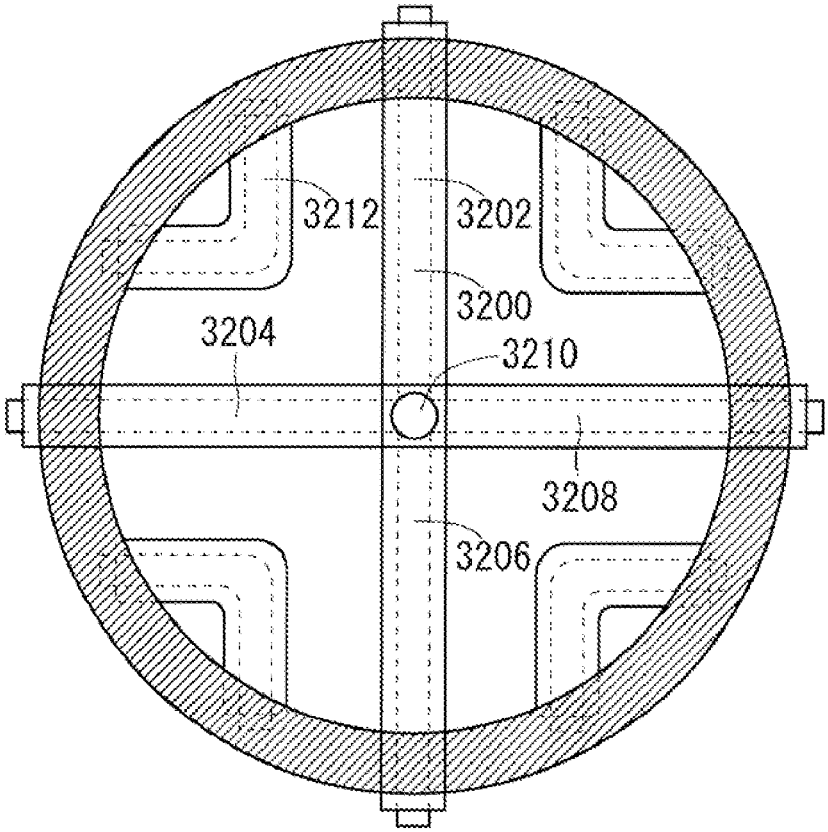
FIG. 23 is a transverse cross-sectional view illustrating another example of the electrode structure according to the third embodiment.

Instead of the anode 3002 having the structure where the three branches 3102, 3104, and 3106 having the straight-bar shape extend radially from the branching part 3100, an anode 3200 having a structure where four branches 3202, 3204, 3206, and 3208 having a straight-bar shape extend radially from a branching part 3210 may be used as shown in a schematic diagram (a transverse cross-sectional view) of FIG. 23. Needless to say, when the anode 3200 is used, an auxiliary electrode 3212 along the branches 3202, 3204, 3206, and 3208 are used. Similarly, an anode having a structure in which five or more branches extend radially from the branching part may be used.

Figure 24:
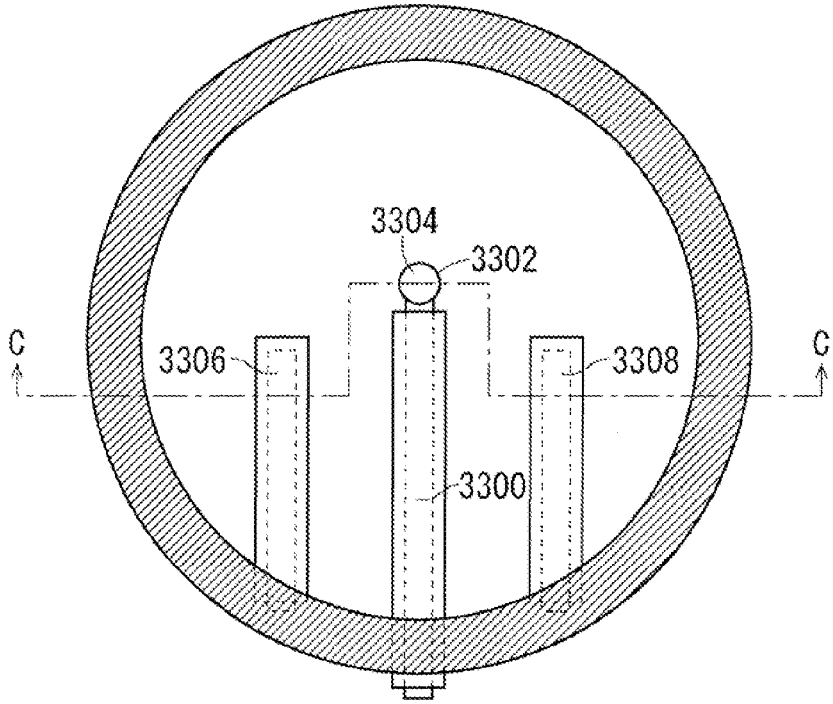
FIG. 24 is a transverse cross-sectional view illustrating another example of the electrode structure according to the third embodiment.
Figure 25:
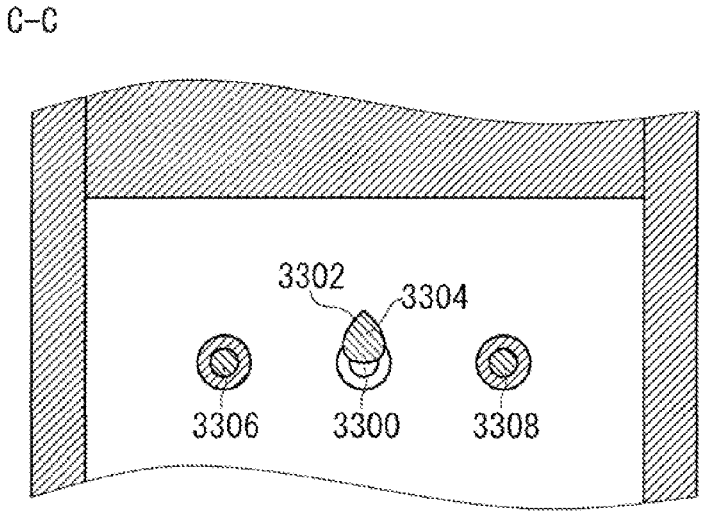
FIG. 25 is a vertical cross-sectional view illustrating another example of the electrode structure according to the third embodiment.

Further, an anode 3300 without the branching part and having an exposed surface 3302 at a front end 3304 may be used as shown in a schematic diagram (a transverse cross-sectional view) of FIG. 24 and a schematic diagram (a vertical cross-sectional view) of FIG. 25. FIG. 24 and FIG. 25 illustrate auxiliary electrodes 3306 and 3308 that are arranged along the anode 3300 and in parallel with the anode 3300.

Figure 26:
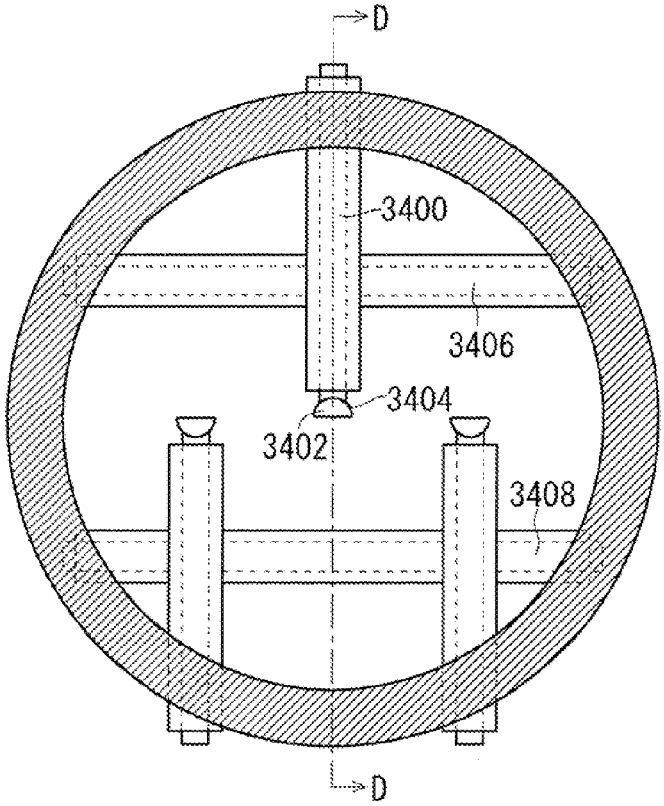
FIG. 26 is a transverse cross-sectional view illustrating another example of the electrode structure according to the third embodiment.
Figure 27:
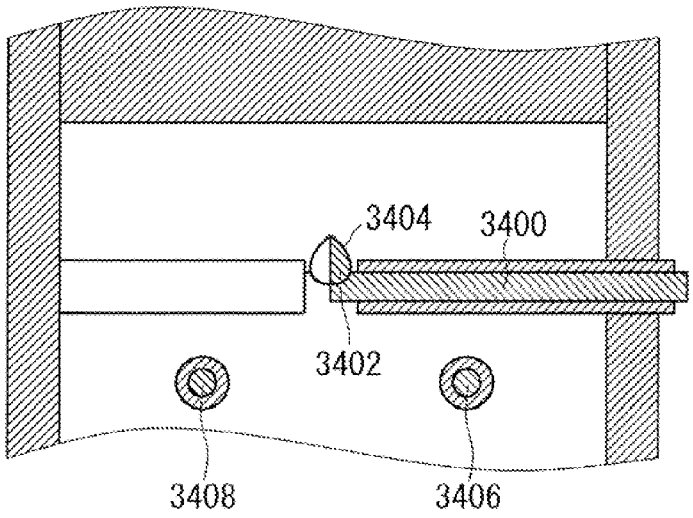
FIG. 27 is a vertical cross-sectional view illustrating another example of the electrode structure according to the third embodiment.

Further, an anode 3400 without the branching part and having an exposed surface 3404 at a front end 3402 may be used as shown in a schematic diagram (a transverse cross-sectional view) of FIG. 26 and a schematic diagram (a vertical cross-sectional view) of FIG. 27. FIG. 26 and FIG. 27 illustrate auxiliary electrodes 3406 and 3408 that are arranged perpendicularly to the anode.

{Fourth Embodiment}

A fourth embodiment relates to the ignition device of the internal combustion engine that uses the electrode structure according to the first embodiment to the third embodiment.

Figure 28:
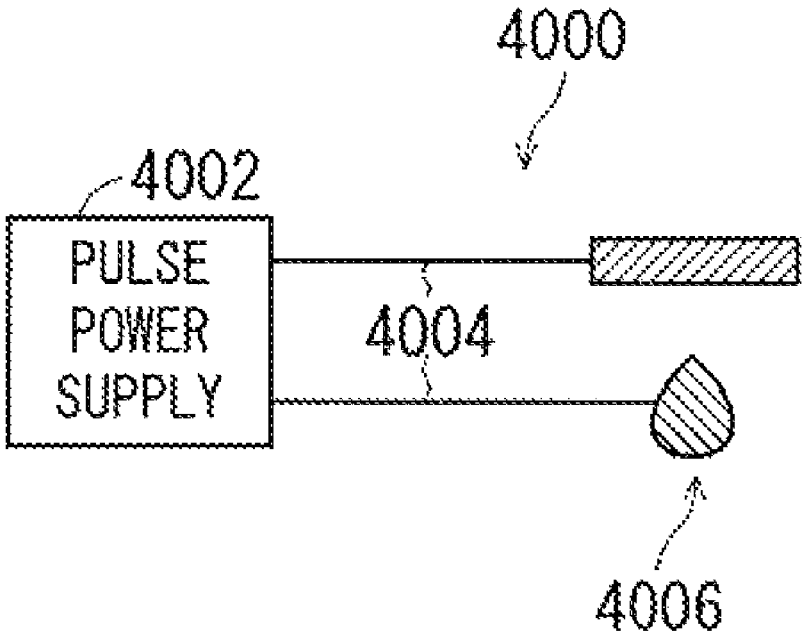
FIG. 28 is a schematic diagram illustrating an ignition device according to a fourth embodiment.

FIG. 28 is a schematic diagram illustrating the ignition device 4000 according to the fourth embodiment.

As shown in FIG. 28, the ignition device 4000 is provided with a pulse power supply 4002, a cable 4004, and an electrode structure 4006. As the electrode structure 4006, any one of the electrode structures according to the first embodiment to the third embodiment is used. The pulse power supply 4002 is connected to the electrode structure 4006 by the cable 4004, and a pulse voltage generated from the pulse power supply 4002 is supplied to the electrode structure 4006 via the cable 4004 serving as a transmission path of the pulse voltage. When the pulse voltage is supplied to the electrode structure 4006, and the electrode structure 1000 or 2000 according to the first embodiment or the second embodiment is used, the pulse voltage is applied between the anode 1002 or 2002 and the cathode 1004 or 2004. When the electrode structure 3000 according to the third embodiment is used, the pulse voltage is applied between the anode 3002 and the combustion bomb 3004, discharge is generated in the combustion space, and the fuel-air mixture filling the combustion space is ignited. A format of the pulse power supply 4002 is not limited, but is desirably an inductive energy storage type in which inductive energy stored in an inductive element such as an inductor or a transformer is discharged and thus the pulse voltage is generated. The pulse power supply 4002 of the inductive energy storage type can easily introduce a remarkably large energy.

The present invention has been described in detail, but the above description is illustrative in all aspects, and the present invention is not limited to the above description. Numerous modified examples that are not illustrated can be assumed without departing from the scope of the present invention.

The invention claimed is:

1. An electrode structure of an ignition device for igniting a fuel-air mixture filling a combustion space of an internal combustion engine, comprising:

a first electrode that is made of a conductor and has a bar shape;

a second electrode made of a conductor;

an auxiliary electrode made of a conductor;

a first dielectric barrier that is made of a dielectric body and partially coats a surface of said first electrode; and a second dielectric barrier that is made of a dielectric body and entirely or partially coats a surface of said auxiliary electrode, wherein the surface of said first electrode includes a first exposed surface exposed in the combustion space, and a first coated surface coated with said first dielectric barrier, a surface of said second electrode includes a second exposed surface exposed in said combustion space, the surface of said auxiliary electrode includes a second coated surface coated with said second dielectric barrier, said first exposed surface is opposed to said second exposed surface with said combustion space therebetween, said first coated surface is opposed to said second coated surface with said first dielectric barrier, said combustion space, and said second dielectric barrier therebetween, and a first distance from said first coated surface to said second coated surface via said first dielectric barrier, said combustion space, and said second dielectric barrier is shorter than a second distance from said first exposed surface to said second exposed surface via said combustion space.

2. The electrode structure according to claim 1, wherein said first exposed surface is at a front end of said first electrode, a first opening is formed on said second electrode, and the second exposed surface is at an outer edge of said first opening, and said first electrode protrudes from said first opening.

3. The electrode structure according to claim 2, wherein said first opening has a circular shape, and said first electrode is arranged on a central axis that passes through a center of said first opening and is perpendicular to said first opening.

4. The electrode structure according to claim 1, wherein two or more of said second electrodes are provided, and said first electrode protrudes from a gap between said two or more second electrodes.

5. The electrode structure according to claim 1, wherein a second opening having a circular shape is formed on said auxiliary electrode, and said first electrode is arranged on a central axis that passes through a center of said second opening and is perpendicular to said second opening.

6. The electrode structure according to claim 1, wherein said first exposed surface has an apex.

7. The electrode structure according to claim 6, wherein said apex faces an extending direction of said first electrode and a direction separating from said second exposed surface.

8. The electrode structure according to claim 1, wherein a portion of said first exposed surface opposed to said second exposed surface has a convex curve.

9. An ignition device for igniting a fuel-air mixture filling a combustion space of an internal combustion engine, comprising:

a pulse power supply;

an electrode structure; and a pulse voltage transmission path for connecting said pulse power supply and said electrode structure, wherein said electrode structure includes a first electrode that is made of a conductor and has a bar shape, a second electrode made of a conductor, an auxiliary electrode made of a conductor, a first dielectric barrier that is made of a dielectric body and partially coats a surface of said first electrode, and a second dielectric barrier that is made of a dielectric body and entirely or partially coats a surface of said auxiliary electrode, the surface of said first electrode includes a first exposed surface exposed in the combustion space, and a first coated surface coated with said first dielectric barrier, a surface of said second electrode includes a second exposed surface exposed in said combustion space, and the surface of said auxiliary electrode includes a second coated surface coated with said second dielectric barrier, said first exposed surface is opposed to said second exposed surface with said combustion space therebetween, said first coated surface is opposed to said second coated surface with said first dielectric barrier, said combustion space, and said second dielectric barrier therebetween, and a first distance from said first coated surface to said second coated surface via said first dielectric barrier, said combustion space, and said second dielectric barrier is shorter than a second distance from said first exposed surface to said second exposed surface via said combustion space.

10. An electrode structure of an ignition device for igniting a fuel-air mixture filling a combustion space of an internal combustion engine, comprising:

a first electrode that is made of a conductor and has a bar shape;

an auxiliary electrode made of a conductor;

a first dielectric barrier that is made of a dielectric body and partially coats said first electrode; and a second dielectric barrier that is made of a dielectric body and entirely or partially coats said auxiliary electrode, wherein a surface of said first electrode includes an exposed surface exposed in said combustion space, a first coated surface coated with said first dielectric barrier, and the surface of said auxiliary electrode includes a second coated surface coated with said second dielectric barrier, said exposed surface is opposed to an inner wall surrounding said combustion space with said combustion space therebetween, said first coated surface is opposed to said second coated surface with said first dielectric barrier, said combustion space, and said second dielectric barrier therebetween, and a first distance from said first coated surface to said second coated surface via said first dielectric barrier, said combustion space, and said second dielectric barrier is shorter than a second distance from said exposed surface to said inner wall via said combustion space.

11. An ignition device for igniting a fuel-air mixture filling a combustion space of an internal combustion engine, comprising:

a pulse power supply;

an electrode structure; and a pulse voltage transmission path for connecting said pulse power supply and said electrode structure, wherein said electrode structure includes a first electrode that is made of a conductor and has a bar shape, an auxiliary electrode made of a conductor, a first dielectric barrier that is made of a dielectric body and partially coats a surface of the first electrode, and a second dielectric barrier that is made of a dielectric body and entirely or partially coats a surface of the auxiliary electrode, the surface of said first electrode includes an exposed surface exposed in said combustion space, a first coated surface coated with said first dielectric barrier, and the surface of said auxiliary electrode includes a second coated surface coated with said second dielectric barrier, said exposed surface is opposed to an inner wall surrounding said combustion space with said combustion space therebetween, said first coated surface is opposed to said second coated surface with said first dielectric barrier, said combustion space, and said second dielectric barrier therebetween, and a first distance from said first coated surface to said second coated surface via said first dielectric barrier, said combustion space, and said second dielectric barrier is shorter than a second distance from said exposed surface to said inner wall via said combustion space.

12. The electrode structure according to claim 2, wherein a second opening having a circular shape is formed on said auxiliary electrode, and said first electrode is arranged on a central axis that passes through a center of said second opening and is perpendicular to said second opening.

13. The electrode structure according to claim 3, wherein a second opening having a circular shape is formed on said auxiliary electrode, and said first electrode is arranged on a central axis that passes through a center of said second opening and is perpendicular to said second opening.

14. The electrode structure according to claim 4, wherein a second opening having a circular shape is formed on said auxiliary electrode, and said first electrode is arranged on a central axis that passes through a center of said second opening and is perpendicular to said second opening.

15. The electrode structure according to claim 2, wherein said first exposed surface has an apex.

16. The electrode structure according to claim 3, wherein said first exposed surface has an apex.

17. The electrode structure according to claim 4, wherein said first exposed surface has an apex.

18. The electrode structure according to claim 2, wherein a portion of said first exposed surface opposed to said second exposed surface has a convex curve.

19. The electrode structure according to claim 3, wherein a portion of said first exposed surface opposed to said second exposed surface has a convex curve.

20. The electrode structure according to claim 4, wherein a portion of said first exposed surface opposed to said second exposed surface has a convex curve.

* * * * *